US006950620B2

(12) United States Patent
Yoshikawa et al.

(10) Patent No.: US 6,950,620 B2
(45) Date of Patent: Sep. 27, 2005

(54) IMAGE FORMING APPARATUS WITH SETTABLE PEAK TO PEAK VOLTAGES APPLIED TO IMAGE BEARING MEMBER

(75) Inventors: Tadanobu Yoshikawa, Ibaraki (JP); Motoki Adachi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/231,278

(22) Filed: Aug. 30, 2002

(65) Prior Publication Data

US 2003/0049048 A1 Mar. 13, 2003

(30) Foreign Application Priority Data

Sep. 4, 2001 (JP) ..... 2001-268083
Aug. 23, 2002 (JP) ..... 2002-243794

(51) Int. Cl.[7] ..... G03G 21/00
(52) U.S. Cl. ..... 399/129
(58) Field of Search ..... 399/129, 98, 99, 399/149

(56) References Cited

U.S. PATENT DOCUMENTS 5,689,778 A * 11/1997 Hayakawa et al. ..... 399/174
5,701,559 A * 12/1997 Ootaka et al. ..... 399/49
5,845,172 A * 12/1998 Saito et al. ..... 399/50
6,421,512 B2 7/2002 Watanabe et al. ..... 399/149
2003/0059231 A1 * 3/2003 Watanabe et al. ..... 399/129
2003/0077088 A1 * 4/2003 Adachi et al. ..... 399/129

FOREIGN PATENT DOCUMENTS

JP 5-241427 * 9/1993
JP 7-92778 * 4/1995
JP 2000-242062 * 9/2000
JP 2000-293015 * 10/2000
JP 2001-100592 * 4/2001
JP 2001-272847 * 10/2001

OTHER PUBLICATIONS

Computer translation of Japanese publication 2001–272847A.*

* cited by examiner

*Primary Examiner*—Quana M. Grainger
(74) *Attorney, Agent, or Firm*—Fitzpatrick, Cella, Harper & Scinto

(57) ABSTRACT

An image forming apparatus including: an image bearing member; an electrifying unit for electrifying the image bearing member at a contact portion in order to form an electrostatic image on the image bearing member, a voltage, in which a direct-current voltage and an alternating-current voltage are superimposed on each other, being applied to the electrifying unit; and a developing unit for developing the electrostatic image on the image bearing member using toner; where after a toner image on the image bearing member is transferred onto a transferring medium, residual toner residing on the image bearing member is carried to the contact portion in accordance with rotation of the image bearing member, and a peak to peak voltage of the alternating-current voltage applied to the electrifying unit in order to discharge the residual toner adhering to the electrifying unit to the image bearing member during a certain period of non-image forming is set so as to be higher than a peak to peak voltage applied during image forming.

12 Claims, 13 Drawing Sheets

FIG. 11

| | | ON IMAGE FORMING | ON CLEANING SEQUENCE |
|---|---|---|---|
| ELECTRIFYING ROLLER | PEAK TO PEAK VOLTAGE | 1400Vpp | 1800Vpp |
| | FREQUENCY | 1150Hz | 1150Hz |
| | DC VOLTAGE | −500V | −500V |
| RESIDUAL TONER UNIFYING MEANS | | 300V | 300V |
| TONER ELECTRIFICATION AMOUNT CONTROL MEANS | | −800V | −800V |
| TRANSFERRING | | 350V | 350V |
| DEVELOPING | AC VOLTAGE | 1800Vpp | OFF |
| | DC VOLTAGE | −350V | −350V |
| | SLEEVE ROTATION | ON | OFF |

FIG. 12

| | | ON IMAGE FORMING | ON CLEANING SEQUENCE (1) (CLEANING OF POSITIVE POLARITY TONER) | ON CLEANING SEQUENCE (2) (CLEANING OF NEGATIVE POLARITY TONER) |
|---|---|---|---|---|
| ELECTRIFYING ROLLER | PEAK TO PEAK VOLTAGE | 1400Vpp | 1800Vpp | 1800Vpp |
| | FREQUENCY | 1150Hz | 1150Hz | 1150Hz |
| | DC VOLTAGE | −500V | 0V | −500V |
| RESIDUAL TONER UNIFYING MEANS | | 300V | 300V | 300V |
| TONER ELECTRIFICATION AMOUNT CONTROL MEANS | | −800V | −800V | −800V |
| TRANSFERRING | | 350V | 350V | 350V |
| DEVELOPING | AC VOLTAGE | 1800Vpp | OFF | OFF |
| | DC VOLTAGE | −350V | −350V | −350V |
| | SLEEVE ROTATION | ON | OFF | OFF |

IMAGE FORMING APPARATUS WITH SETTABLE PEAK TO PEAK VOLTAGES APPLIED TO IMAGE BEARING MEMBER

BACKGROUND OF THE INVENTION

1. Field of the Invention

The present invention relates to an image forming apparatus that uses an electrophotographic system, and more particularly relates to an image forming apparatus such as a copying machine, a printer, or a facsimile.

2. Related Background Art

Conventionally, an image forming apparatus, such as a copying machine, a printer, or a facsimile, that uses an electrophotographic system generally includes an electrophotographic photosensitive member (photosensitive member) functioning as an image bearing member that is of rotary drum type, an electrifying device that performs electrification processing so that the photosensitive member is uniformly electrified to have a predetermined polarity and potential, an exposing apparatus functioning as an information writing means for forming an electrostatic latent image on the photosensitive member subjected to the electrification processing, a developing apparatus that visualizes the electrostatic latent image formed on the photosensitive member as a developer image (toner image) using toner functioning as developer, a transferring apparatus that transfers the toner image from the surface of the photosensitive member to a recording material such as paper, a cleaning device that cleans the photosensitive member surface by removing toner (residual developer, transfer residual toner) residing on the photosensitive member after a transferring step although the amount of the residing toner is small, and a fixing apparatus that fixes the toner image on the recording material. The photosensitive member is repeatedly subjected to an electrophotographic process (an electrifying step, an exposing step, a developing step, a transferring step, and a cleaning step) and is used to perform image forming.

Toner residing on the photosensitive member after the transferring step is removed from the surface of the photosensitive member by the cleaning device, is accumulated in the cleaning device, and becomes waste toner. However, from the viewpoint of environmental protection and effective use of resources, it is preferred that the generation of such waste toner is prevented.

Accordingly, there is used an image forming apparatus that returns transfer residual toner (so-called waste toner) collected by the cleaning device to the developing apparatus for reuse.

Also, there is used an image forming apparatus using a cleanerless system that, without using any cleaning device, reuses the transfer residual toner residing on the photosensitive member after the transferring step by removing and recovering the toner from the photosensitive member by performing a "cleaning-simultaneous-with-developing" operation at the developing apparatus.

By performing the cleaning-simultaneous-with-developing operation, the transfer residual toner on the photosensitive member after the transferring step is recovered at the developing apparatus during the following developing steps. That is, this is a method with which the photosensitive member, onto which the transfer residual toner adheres, is continuously charged and exposed during the formation of an electrostatic latent image. In a step for developing this electrostatic latent image, there is applied a fog removal bias (fog removing potential difference Vback that is a potential difference between a direct-current voltage applied to the developing apparatus and the potential of the surface of the photosensitive member). As a result, residual toner on the photosensitive member surface that exists on each portion (non-image portion) that should not be developed is removed and recovered at the developing apparatus.

With this system, the transfer residual toner is recovered at the developing apparatus and is reused for the developing of an electrostatic latent image in the following steps. Consequently, it becomes possible to prevent the generation of waste toner and also to reduce the burden during maintenance work. Also, there is not used any cleaner, so that this system is advantageous when an image forming apparatus is miniaturized.

In an image forming apparatus that uses the cleanerless system adopting the cleaning-simultaneous-with-developing method described above, in the case where a contact electrifying device that electrifies the surface of the photosensitive member while being abutted against the photosensitive member is used as an electrifying device, there is a case where toner, out of transfer residual toner on the photosensitive member, that has an electrification polarity reversed to a polarity opposite to a normal polarity adheres to the contact electrifying device while the transfer residual toner is passing through a contact nip portion (electrifying portion) between the photosensitive member and the contact electrifying device. As a result, this phenomenon may cause a situation where the contact electrifying device is polluted with toner at a level exceeding a permissible level and becomes a cause of poor electrification.

That is, toner having an electrification polarity that is inherently reversed to a polarity opposite to the normal polarity coexists in toner functioning as developer although the amount of such toner is small. Also, even among toner whose electrification polarity is the normal polarity, there exists toner, whose electrification polarity is reversed as a result of the influence of a transferring bias or separation discharge, or toner whose electric charge amount is reduced as a result of diselectrification.

As a result, the transfer residual toner contains toner whose electrification polarity is the normal polarity, toner whose electrification polarity is reversed to the opposite polarity, and toner whose electric charge amount is small. The reversed toner and toner with a small electric charge amount in the transfer residual toner tend to adhere to the contact electrifying device while passing through the contact nip portion (electrifying portion) between the photosensitive member and the contact electrifying device.

Also, in order to remove and recover the transfer residual toner on the photosensitive member through the cleaning-simultaneous-with-developing operation, it is required that the electrification polarity of the transfer residual toner on the photosensitive member that passes through the electrifying portion and is carried to the developing portion is the normal polarity and its electric charge amount is the electrification amount of toner that is possible to develop an electrostatic latent image on the photosensitive member by the developing apparatus. It is impossible to remove and recover the reversed toner or the toner having an inappropriate electric charge amount from the photosensitive member into the developing apparatus, so that there is a fear that such toner becomes a cause of faulty images.

Even if transfer residual toner that exists on the photosensitive drum and is carried from the transferring portion to the electrifying portion contains toner having an electrification polarity that is the normal polarity, toner having an opposite polarity, and toner having a small electric charge amount, it is possible to prevent the adhesion of the transfer residual toner to the contact electrifying device by aligning the electrification polarities of the toner with the normal polarity through electrification to the normal polarity and unifying the electric charge amounts of the toner using a toner electrification amount control means.

However, the transfer residual toner electrified by the toner electrification amount control means for the sake of preventing the toner adhesion to the contact electrifying device has an electric charge amount that is larger than that of toner that is capable of developing an electrostatic latent image on the photosensitive member, so that it is difficult to remove and recover the transfer residual toner through the cleaning-simultaneous-with-cleaning operation at the developing apparatus. Consequently, there is a fear that faulty images are generated because the toner residing on the photosensitive member is superimposed on the next image.

In view of this problem, conventionally, a toner electrification amount control means for electrifying the transfer residual toner on the photosensitive member is provided at a position that is on the upstream side of the contact electrifying device and on the downstream side of the transferring means in a direction in which the photosensitive member moves. In addition, a transfer residual toner unifying means that unifies the transfer residual toner is provided at a position that is on the upstream side of the toner electrification amount control means and on the downstream side of the transferring means. By applying constant direct-current voltages to these toner electrification amount control means and the transfer residual toner unifying means, there is solved the problem described above.

That is, the residual toner residing on the photosensitive member after the transferring is unified by the transfer residual toner unifying means and the unified transfer residual toner on the photosensitive member is electrified to have the normal polarity by the toner electrification amount control means. Following this, simultaneously with the electrification of the surface of the photosensitive member by the contact electrifying device, the transfer residual toner electrified by the toner electrification amount control means is electrified to have an electric charge amount that is proper for the removal and recovery by the cleaning-simultaneous-with-developing operation at the developing apparatus. In this manner, the transfer residual toner is recovered at the developing apparatus.

However, in accordance with the diversification of user's needs in recent years, there occurs a case where a large quantity of transfer residual toner is generated at a time as a result of an operation for successively forming images, such as photographic images, having high printing ratios (image ratios or coverage ratios), a system that performs multiplex developing on a photosensitive member in an image forming apparatus that is capable of forming a color image, and the like.

In this case, there occurs the adhesion of the transfer residual toner to the contact electrifying device and the following rotation of the transfer residual toner on the photosensitive member due to the poor removal and recovery in the developing apparatus. As a result, there is a case where faulty images are generated due to poor electrification and the like.

SUMMARY OF THE INVENTION

The present invention has been made in view of the problem described above in the related art.

It is an object of the present invention is to provide an image forming apparatus that is capable of efficiently discharging residual toner adhering to an electrifying means onto an image bearing member.

Other objects of the present invention will become apparent from the following detailed description to be made with reference to the accompanying drawings.

BRIEF DESCRIPTION OF THE DRAWINGS

In the accompanying drawings:

FIG. 11 is a table showing voltages applied during a cleaning sequence of the third embodiment;

FIG. 12 is a table showing voltages applied during a cleaning sequence of the fourth embodiment;

DESCRIPTION OF THE PREFERRED EMBODIMENTS

An image forming apparatus according to the present invention will be described in more detail below with reference to the drawings.

First Embodiment

Figure 1:
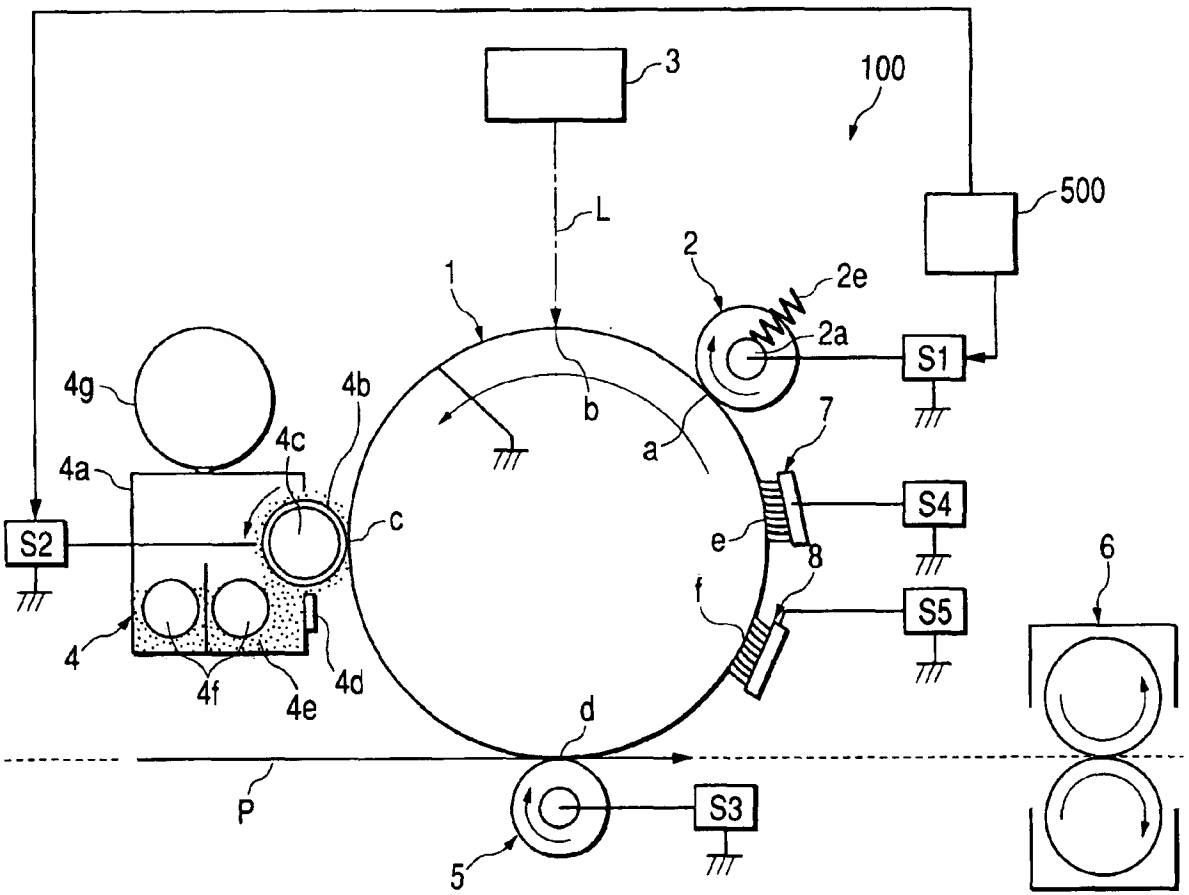
FIG. 1 is a schematic drawing showing an outline of the construction of an embodiment of an image forming apparatus according to the present invention.

FIG. 1 shows the outline of the construction of an embodiment of the image forming apparatus according to the present invention. An image forming apparatus 100 of this embodiment is a laser beam printer (printer) 100 that adopts an electrophotographic system using a contact electrifying system, a reversal developing system, and a cleanerless system.

Overall Construction of Printer

First, the overall construction of the printer 100 of this embodiment will be described with reference to FIG. 1.

(a) Image Bearing Member

The printer 100 includes an electrophotographic photosensitive member of rotary drum type (hereinafter referred to as the "photosensitive drum") as the image bearing member. In this embodiment, the photosensitive drum 1 is an organic photoconductive body (OPC) whose electrification characteristic is a negative electrification property, has an outer diameter of 60 mm, and is rotationally driven about a center spindle at a process speed (circumferential speed) of 100 mm/sec in a counterclockwise direction indicated by an arrow.

Figure 2:
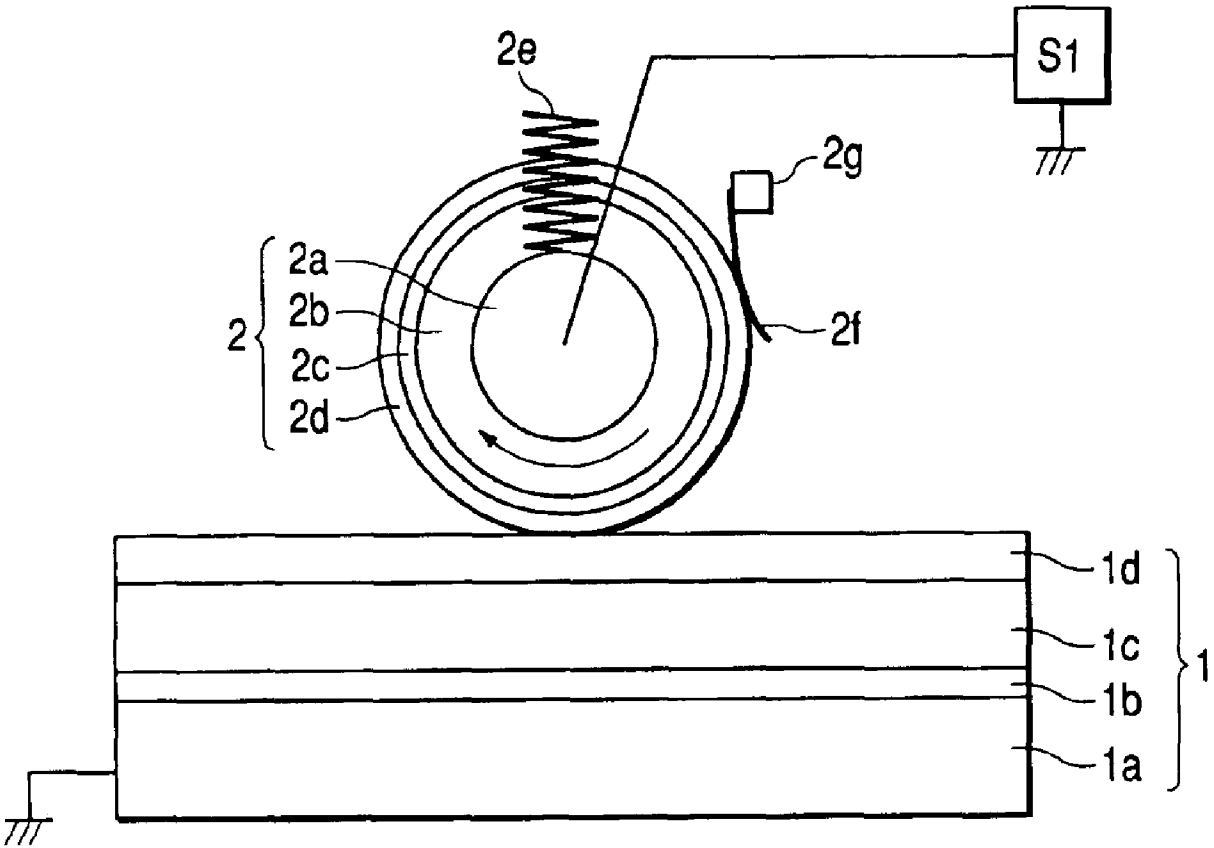
FIG. 2 is a schematic drawing showing the layer construction of a photosensitive drum and the layer construction of an electrifying roller provided in the image forming apparatus in FIG. 1.

As shown in FIG. 2, the photosensitive drum 1 has a construction where three layers that are an underlying layer 1*b* for suppressing the interference of light and improving the adhesive property of an upper layer, a photocharge generating layer 1*c*, and a charge transporting layer 1*d* are applied so as to be stacked in this order on the surface of a cylinder (conductive drum base) 1*a* made of aluminum.

(b) Charging Means

The printer 100 includes a contact electrifying device (contact charger) 2 as a charging means for uniformly electrifying the peripheral surface of the photosensitive drum 1. In this embodiment, the contact electrifying device 2 is an electrifying roller (roller charger) and performs electrification by utilizing a discharge phenomenon occurring at a minute gap with the photosensitive drum 1.

Both the end portions of a metal core (supporting member) 2*a* of the electrifying roller 2 are respectively held by bearing members (not shown) so as to be freely rotated. In addition, this metal core 2*a* is energized toward the photosensitive drum 1 by a pressure spring 2*e* and is abutted against the surface of the photosensitive drum 1 with a predetermined pressing force. With this construction, the electrifying roller 2 is rotated by following the rotation of the photosensitive drum 1. The press-contacting portion between the photosensitive drum 1 and the electrifying roller 2 is a charging portion (charging nip portion) a.

To the metal core 2*a* of the electrifying roller 2, there is applied a charging bias voltage by a power source S1 under a predetermined condition. As a result of this voltage application, the peripheral surface of the rotating photosensitive drum 1 is subjected to contact electrification processing so as to have a predetermined polarity and potential. In this embodiment, the electrifying bias voltage applied to the electrifying roller 2 is an oscillating voltage where a direct-current voltage (Vdc) and an alternating-current voltage (Vac) are superimposed on each other. In more detail, the electrifying bias voltage is an oscillating voltage where a direct-current voltage of −500 V and an alternating-current voltage having a frequency f of 1 kHz, a peak to peak voltage Vpp of 1.5 kv, and a sine-wave are superimposed on each other. With this electrifying bias voltage application, the peripheral surface of the photosensitive drum 1 is uniformly contact electrified and has a potential of −500 V (dark potential Vd).

The longitudinal length of the electrifying roller 2 is 320 mm. Also, as shown in the schematic drawing in FIG. 2 that shows the layer constructions, the electrifying roller 2 has a three-layer construction where a lower layer 2*b*, an intermediate layer 2*c*, and a surface layer 2*d* are successively stacked around the outside of the metal core 2*a* in this order. The lower layer 2*b* is a foamed sponge layer for reducing an electrification sound. The surface layer 2*d* is a protective layer that is provided in order to prevent the occurrence of leakage even in the case where a defect, such as a pinhole, exists on the photosensitive drum 1. The more detailed specifications of the electrifying roller 2 of this embodiment are as follows.

(1) The metal core 2*a* is a stainless round bar with a diameter of 6 mm.
(2) The lower layer 2*b* is a foamed EPDM, in which carbon has been dispersed. This lower layer 2*b* has a specific gravity of 0.5 g/cm$^3$, a volume resistivity value of $10^2$ to $10^9$ Ωcm, a layer thickness of 3.0 mm, and a length of 320 mm.
(3) The intermediate layer 2*c* is NBR based rubber, in which carbon has been dispersed. This intermediate layer 2*c* has a volume resistivity value of $10^2$ to $10^5$ Ωcm and a layer thickness of 700 μm.
(4) The surface layer 2*d* is a TORESIN resin of a fluorine compound in which tin oxide and carbon have been dispersed. This surface layer 2*d* has a volume resistivity value of $10^7$ to $10^{10}$ Ωcm, surface roughness (ten-point average surface roughness Ra according to JIS standards) of 1.5 μm, and a layer thickness of 10 μm.

As shown in FIG. 2, there is provided an electrifying roller cleaning member 2*f*. In this embodiment, this electrifying roller cleaning member 2*f* is a cleaning film having flexibility. This cleaning member 2*f* is disposed parallel to the longitudinal direction of the electrifying roller 2. In addition, one end of the cleaning member 2*f* is fixed to a supporting member 2*g* that reciprocates by a fixed amount with reference to the longitudinal direction. Further, the cleaning member 2*f* is disposed so that a contact nip with the electrifying roller 2 is formed on a surface in proximity to a free end side.

The supporting member 2*g* is driven by a drive motor (not shown) of the printer 100 through a gear train so as to be reciprocated by a fixed amount in the longitudinal direction. As a result, the surface 2*d* of the electrifying roller 2 is rubbed by the cleaning film 2*f*. As a result of this rubbing, adhesive contaminants (such as particulate toners or external additives) adhering on the surface of the electrifying roller 2 are removed.

(c) Information Writing Means

In the printer 100, an exposing apparatus 3 functioning as an exposing means is provided as an information writing means for forming an electrostatic latent image on a surface of the photosensitive drum 1 having been subjected to electrification processing. In this embodiment, the exposing apparatus 3 is a laser beam scanner using a semiconductor laser. This laser beam scanner 3 outputs laser light L modulated in accordance with an image signal sent from a host processing apparatus, such as an image reading device (not shown), to a printer side, and performs laser scanning exposure (image exposure) on the uniformly electrified surface of the rotating photosensitive drum 1 at an exposing position b. As a result of this laser scanning exposure, the potential in each portion of the surface of the photosensitive drum 1 that has been irradiated with the laser light L is lowered, and an electrostatic latent image corresponding to the image information is successively formed on the surface of the rotating photosensitive drum 1.

(d) Developing Means

The printer 100 includes a developing apparatus (developing device) 4 as a developing means for supplying toner in developer including toner and carrier to the electrostatic latent image on the photosensitive drum 1 and for reversal-developing the electrostatic latent image as a toner image (developer image). In this embodiment, the developing apparatus 4 is a developing apparatus that adopts a two-component contact developing system that performs developing using two-component developer while having a magnetic brush contact the photosensitive drum.

The developing apparatus 4 includes a developing container 4*a* and a non-magnetic developing sleeve 4*b* functioning as a developer carrying member. A part of the outer peripheral surface of the developing sleeve 4*b* is exposed to the outside of the developing apparatus 4 and is disposed so as to be rotated within the developing container 4*a*. Within the developing sleeve 4*b*, there is inserted and disposed a magnet roller 4*c* fixed so as not to be rotated. A developer coating blade 4*d* is provided so as to oppose the developing sleeve 4*b*. The developing container 4*a* contains two-component developer 4*e* and developer agitating members 4*f* are disposed on the bottom portion side within the developing container 4*a*. Also, replenishment toner is contained in a toner hopper 4*g*.

The two-component developer 4*e* within the developing container 4*a* is a mixture that mainly contains non-magnetic toner and magnetic carrier, and is agitated by the developer agitating members 4*f*. In this embodiment, the magnetic carrier has a resistance of around $10^{13}$ Ωcm and has a particle diameter of 40 μm (volume average particle diameter: with a laser diffraction type particle size distribution measuring apparatus HEROS (manufactured by Jeol Ltd.), a range of from 0.5 to 350 μm is divided into 32 logarithms for measurement and the volume average particle diameter is set as the median diameter of volume 50%). The toner is triboelectrified to have a negative polarity through the rubbing with the magnetic carrier.

The developing sleeve 4*b* is disposed so as to closely oppose the photosensitive drum 1 by maintaining the closest distance (S-Dgap) with the photosensitive drum 1 at 350 μm. A portion, in which the photosensitive drum 1 and the developing sleeve 4*a* oppose each other, is a developing portion c.

The developing sleeve 4*b* is rotationally driven in the developing portion c in a direction opposite to a direction in which the photosensitive drum 1 advances. Because of the magnetic force of the magnet roller 4*c* within the developing sleeve 4*b*, a part of the two-component developer 4*e* within the developing container 4*a* is absorbed and held on the outer peripheral surface of the developing sleeve 4*b* as a magnetic brush layer. This magnetic brush layer is rotationally carried in accordance with the rotation of the developing sleeve 4*b*, is converted into a predetermined thin layer by the developer coating blade 4*d*, and rubs the surface of the photosensitive drum 1 in moderation while contacting the photosensitive drum surface in the developing portion c.

To the developing sleeve 4*b*, there is applied a predetermined developing bias from a power source S2. In this embodiment, the developing bias voltage applied to the developing sleeve 4*b* is an oscillating voltage where a direct-current voltage (Vdc) and an alternating-current voltage (Vac) are superimposed on each other. In more detail, the developing bias voltage is an oscillating voltage where a direct-current voltage of −350 V and an alternating-current voltage having a frequency f of 8.0 kHz, a peak to peak voltage Vpp of 1.8 kV, and a square waveform are superimposed on each other.

The toner component in the developer coated as a thin layer on the surface of the rotating developing sleeve 4*b* and carried to the developing portion c in this manner selectively adheres to the surface of the photosensitive drum 1 in accordance with the electrostatic latent image by an electric field generated by the developing bias. In this manner, the electrostatic latent image is developed as a toner image. In the case of this embodiment, toner adheres to an exposed light portion of the surface of the photosensitive drum 1 and the electrostatic latent image is reversal-developed.

During this operation, the electrification amount of toner developed on the photosensitive drum 11 is −25 μC/g under an environment where the temperature is 23 degrees centigrade and an absolute moisture amount is 10.5 g/m$^3$.

The developer thin layer on the developing sleeve 4*b* having passed through the developing portion c returns to a developer reservoir portion within the developing container 4*a* in accordance with the continuing rotation of the developing sleeve 4*b*.

In order to maintain the toner density of the two-component developer 4*e* within the developing container 4*a* within an approximately constant range, the toner density of the two-component developer 4*e* within the developing container 4*a* is detected using, for instance, an optical toner density sensor. A toner hopper 4*g* is driven and controlled in accordance with information concerning the detection, and the toner within the toner hopper 4*g* is replenished to the two-component developer 4*e* within the developing container 4*a*. The toner replenished to the two-component developer 4*e* is agitated by the agitating members 4*f*.

(e) Transferring Means and Fixing Means

The printer 100 includes a transferring apparatus 5 as a transferring means. In this embodiment, the transferring apparatus 5 is a transferring roller. This transferring roller 5 is brought into press contact with the photosensitive drum 1 with a predetermined pressing force and its press-contacting nip portion is a transferring portion d. A recording material (transferring medium) P is fed to this transferring portion d from a sheet feeding mechanism portion (not shown) at a predetermined control timing.

The recording material P fed to the transferring portion d is conveyed while being nipped between the rotating photosensitive drum 1 and the transferring roller 5. During this operation, a transferring bias (+2 kV, in this embodiment) having the positive polarity, that is a polarity opposite to the negative polarity that is the normal electrification polarity of toner, is applied to the transferring roller 5 from a power source S3. As a result of this bias application, the toner image on the surface side of the photosensitive drum 1 is successively electrostatically transferred to the surface of the recording material P nipped and conveyed in the transferring portion d.

The recording material P that has passed through the transferring portion d and has received the transferred toner image is successively separated from the surface of the photosensitive drum 1 and is conveyed to a fixing apparatus 6. In this embodiment, the fixing apparatus 6 is a thermal roller fixing apparatus. The recording material P is subjected to processing for fixing the toner image by this fixing apparatus 6 and is outputted as an image forming material (print or copy).

Cleanerless System and Toner Electrification Amount Control

The printer 100 of this embodiment adopts a so-called cleanerless system and is not provided with a cleaning device specialized in the removal of transfer residual toner (residual toner) that somewhat resides on the surface of the photosensitive drum 1 after the toner image transferring onto the recording material P.

The transfer residual toner on the surface of the photosensitive drum 1 after the transferring is carried to the developing portion c by passing through the charging portion a and the exposing portion b in accordance with the continuing rotation of the photosensitive drum 1, and is removed and recovered through the cleaning simultaneous with developing by the developing apparatus 4 (cleanerless system).

In this embodiment, the developing sleeve 4*b* of the developing apparatus 4 is rotated in a direction opposite to a direction in which the surface of the photosensitive drum 1 advances in the developing portion c, as described above. The rotation of the developing sleeve 4*b* like this is advantageous when transfer residual toner on the photosensitive drum 1 is recovered.

The transfer residual toner on the photosensitive drum 1 passes through the exposing portion b and an exposing step is performed from above of the transfer residual toner. In usual cases, the amount of the transfer residual toner is small, so that there appears no significant influence of the exposing step performed from above of the transfer residual toner.

It should be noted here that toner whose electrification polarity is the normal polarity, toner having an opposite polarity (reversed toner), and toner whose electric charge amount is small coexist in the transfer residual toner, as described above. Therefore, if the reversed toner or the toner with a small electric charge amount contained in the transfer residual toner adheres to the electrifying roller 2 while passing through the electrifying portion a, there occurs a situation where the electrifying roller 2 is polluted with the toner at a level exceeding a permissible level and therefore poor electrification occurs.

Also, in order to effectively perform the removing and recovering operation simultaneously with the developing operation by the developing apparatus 4 for the transfer residual toner on the photosensitive drum 1, the triboelectrification state of the transfer residual toner becomes an important factor. That is, it is preferable that the transfer residual toner on the photosensitive drum 1 carried by the developing portion c has an electrification polarity that is the normal polarity and, in addition, its electric charge amount is an electrification amount of toner with which it is possible for the developing apparatus to develop an electrostatic latent image on the photosensitive drum 1.

There is a fear that toner having a reversed electrification polarity or toner having an inappropriate electric charge amount can not be removed or recovered from the surface of the photosensitive drum 1 to the developing apparatus 4 and that this will become the cause of faulty images.

In view of this problem, a transfer residual toner unifying means (residual developer image unifying means) 8 for unifying the transfer residual toner on the photosensitive drum 1 is provided at a position that is on the downstream side of the transferring portion d in a direction in which the photosensitive drum 1 rotates. Also, a toner electrification amount control means (developer electrification amount control means) 7 for aligning the electrification polarities of the transfer residual toner with the negative polarity that is the normal polarity is provided at a position that is on a downstream side of the transfer residual toner unifying means 8 in the rotational direction of the photosensitive drum and is on an upstream side of the electrifying portion a in the rotational direction of the photosensitive drum.

In general, the transfer residual toner that has not been transferred onto the recording material P in the transferring portion d and resides on the photosensitive drum 1 contains in a mixed state reversed toner and toner whose electric charge amount is inappropriate. Therefore, first, the transfer residual toner is diselectrified by the transfer residual toner unifying means 8. Next, the transfer residual toner is electrified to have the normal polarity again by the toner electrification amount control means 7. By doing so, it becomes possible to effectively prevent the adhesion of the transfer residual toner to the electrifying roller 2 and to completely remove and recover the transfer residual toner at the developing apparatus 4. As a result, it becomes possible to strictly prevent the occurrence of a ghost image resulting from a transfer residual toner image pattern.

In this embodiment, the transfer residual toner unifying means 8 and the toner electrification amount control means 7 are each a brush-shaped member having moderate conductivity and are disposed so that their brush portions contact the surface of the photosensitive drum 1. As a result, there are formed a contact portion f between the transfer residual toner unifying means 8 and the surface of the photosensitive drum 1 and a contact portion e between the toner electrification amount control means 7 and the surface of the photosensitive drum 1.

A direct-current voltage having a positive polarity is applied by a power source S5 to the transfer residual toner unifying means 8, and a direct-current voltage having a negative polarity is applied by a power source S4 to the toner electrification amount control means 7. In more detail, under an environment where the temperature is 23 degrees centigrade and the absolute moisture amount is 10.5 g/m$^3$, a direct-current voltage of +400 V is applied to the transfer residual toner unifying means 8 and a direct-current voltage of −800 V is applied to the toner electrification amount control means 7.

In the transferring portion d, the transfer residual toner residing on the photosensitive drum 1 after the transferring of a toner image onto the recording material P reaches the contact portion f between the transfer residual toner unifying means 8 and the photosensitive drum 1 and is unified by the transfer residual toner unifying means 8 so as to have an electric charge amount of around 0 $\mu$C/g. Further, the transfer residual toner on the surface of the photosensitive drum 1 unified by the transfer residual toner unifying means 8 reaches the contact portion e between the toner electrification amount control means 7 and the photosensitive drum 1 and its electrification polarities are aligned with the negative polarity that is the normal polarity by the toner electrification amount control means 7.

By aligning the electrification polarities of the transfer residual toner with the negative polarity that is the normal polarity, while the surface of the photosensitive drum 1 is being electrified from above of the transfer residual toner in the contact portion a between the electrifying roller 2 and the photosensitive drum 1, there is increased the mirroring force of the transfer residual toner to the photosensitive drum 1 and there is prevented the adhesion of the transfer residual toner to the electrifying roller 2. To do so, it is preferable that the electric charge amount given by the toner electrification amount control means 7 to the transfer residual toner is at least equal to around twice as large as the toner electrification amount during developing. Such an electric charge amount is −70 $\mu$C/g under an environment where the temperature is 23 degrees centigrade and the absolute moisture amount is 10.5 g/m$^3$.

Next, there will be described the recovery of transfer residual toner in the developing step. As described above, the developing apparatus 4 recovers and cleans the transfer residual toner simultaneously with developing. Note that there also exists a period during which only the recovery of the transfer residual toner is performed. The toner electrification amount (average value) applied for the developing of an electrostatic latent image on the photosensitive drum 1 is −25 μC/g under an environment where the temperature is 23 degrees centigrade and the absolute moisture amount is 10.5 g/m$^3$.

Here, the relation between the recovery property of the transfer residual toner to the developing apparatus 4 and the toner electrification amount under the developing condition in this embodiment is shown in Table 1 given below.

TABLE 1

| Electric charge amount (μC/g) | Recovery property |
|---|---|
| −10.0 | poor |
| −12.5 | good |
| −15.0 | good |
| −30.0 | good |
| −40.0 | good |
| −45.0 | good |
| −50.0 | poor |

As can be seen from Table 1, it is required that the toner electrification amount for recovering the transfer residual toner on the photosensitive drum 1 to the developing apparatus 4 is 0.5 to 1.8 times as large as the toner electrification amount during developing (−25 μC/g).

However, as described above, the transfer residual toner that has been significantly electrified to have the negative polarity of −70 μC/g by the toner electrification amount control means 7 in order to prevent the adhesion of toner to the electrifying roller 2 is required to be diselectrified for the sake of recovery at the developing apparatus 4.

Here, the relation between the toner electrification amount after the toner, whose electric charge amount is −70 μC/g, on the photosensitive drum 1 passes through the electrifying roller 2 and the alternating-current voltage Vpp applied to the electrifying roller 2 is shown in Table 2 given below.

TABLE 2

| Applied alternating-current voltage (V) | Electric charge amount (μC/g) |
|---|---|
| 1000 | −68.0 |
| 1200 | −45.0 |
| 1400 | −35.0 |
| 1600 | −24.0 |
| 1800 | −12.0 |
| 2000 | −7.0 |

As can be seen from Table 2, the toner with the electric charge amount of −70 μC/g on the photosensitive drum 1 is diselectrified in accordance with the increase of the alternating-current voltage Vpp.

An alternating-current voltage (frequency f=1 KHz, peak voltage Vpp=1.5 kV) is applied to the electrifying roller 2 in order to electrify the peripheral surface of the photosensitive drum 1. Consequently, the transfer residual toner on the photosensitve drum 1 is alternately diselectrified. Under an alternating-current voltage condition like this, the electric charge amount (=−70 μC/g) of the transfer residual toner becomes −30 μC/g after passing through the electrifying portion a. As a result, in the developing step, the transfer residual toner adhering to each portion, to which toner on the photosensitive drum 1 should not adhere, is recovered to the developing apparatus 4.

In this manner, (i) there is prevented the adhesion of transfer residual toner to the electrifying roller 2 through electrification processing where the electric charge amount of the transfer residual toner carried from the transferring portion d to the electrifying portion a in accordance with the rotation of the photosensitive drum are aligned with the negative polarity that is the normal polarity by the toner electrification amount control means 7. Also, (ii) simultaneously with the electrification of the photosensitive drum 1 to a predetermined potential by the electrifying roller 2, the electric charge amount of the transfer residual toner electrified by the toner electrification amount control means 7 to have the negative polarity that is the normal polarity is controlled to an appropriate electric charge amount with which it is possible to develop an electrostatic latent image on the photosensitive drum by the developing apparatus 4. As a result of these operations (i) and (ii), there is efficiently performed the recovery of the transfer residual toner at the developing apparatus.

Prevention of Accumulation of Transfer Residual Toner to Electrifying Roller and Removal and Recovery by Developing Apparatus The cleanerless system described above (in particular, the cleaning-simultaneous-with-developing cleaning system) is preferable because it becomes possible to save the necessity to specially provide a cleaning device that is ordinarily used with a conventional technique, to reuse the residual toner without generating waste toner, and to save the necessity to perform burdensome maintenance work. The cleanerless system also significantly contributes to the miniaturization of the apparatus. In addition, it becomes possible to preserve the environment and to effectively use resources.

As described above, however, in accordance with the diversification of users' needs in recent years, there is a case where a large quantity of transfer residual toner is generated at a time as a result of an operation for successively forming images having high printing ratios, such as photographic images, a system that performs multiplex developing on the photosensitive drum 1 in an image forming apparatus that is capable of forming a color image, and the like.

In this case, the transfer residual toner adheres to and is accumulated on the electrifying roller 2. In addition, there occurs the following rotation of the transfer residual toner on the photosensitive drum 1 due to poor removal and recovery at the developing apparatus 4. As a result, there are generated faulty images due to poor electrification or the like.

In view of this problem, as a result of the earnest consideration, the inventors of the present invention have found that by performing the control described below, it becomes possible to prevent the adhesion and accumulation of the transfer residual toner to the electrifying roller 2 and to efficiently remove and recover the transfer residual toner generated in quantity with the developing apparatus 4 even under the circumstance described above.

That is, in this embodiment, as a condition concerning the voltage applied to the electrifying roller 2, a condition concerning an alternating-current voltage (in more detail, the peak to peak voltage value, voltage waveform, and waveform frequency of the alternating-current voltage) is changed from that during image forming at a predetermined timing of non-image forming. In this embodiment, this changing operation is performed during the post-rotation of the photosensitive drum 1 after the image forming (a period from the completion of the image forming to a timing at which the image forming apparatus is placed in a standby state). By doing so, it becomes possible to perform cleaning of the electrifying roller 2 by performing an operation (discharging operation) for discharging the transfer residual toner adhering to the peripheral surface of the electrifying roller 2 onto the photosensitive drum 1.

Following this, in order to remove and recover the transfer residual toner returned onto the photosensitive drum 1 at the developing apparatus 4, a difference between the potential of the developing sleeve 4*b* and the potential on the photosensitive drum 1 (so-called fog removal potential difference Vback) is changed from the potential difference during image forming, thereby enhancing the recovery efficiency. The fog removal potential difference Vback is the potential difference between the surface potential in each non-image portion of the photosensitive drum 1 and a direct-current voltage applied to the developing sleeve 4*b*. The image forming apparatus of this embodiment adopts a reversal developing system, so that the fog removal potential difference Vback is a potential difference between the surface potential in each portion, which is not exposed, of the photosensitive drum 1 electrified by the electrifying roller 2 and the surface potential of the developing sleeve 4*b*.

Figure 8:
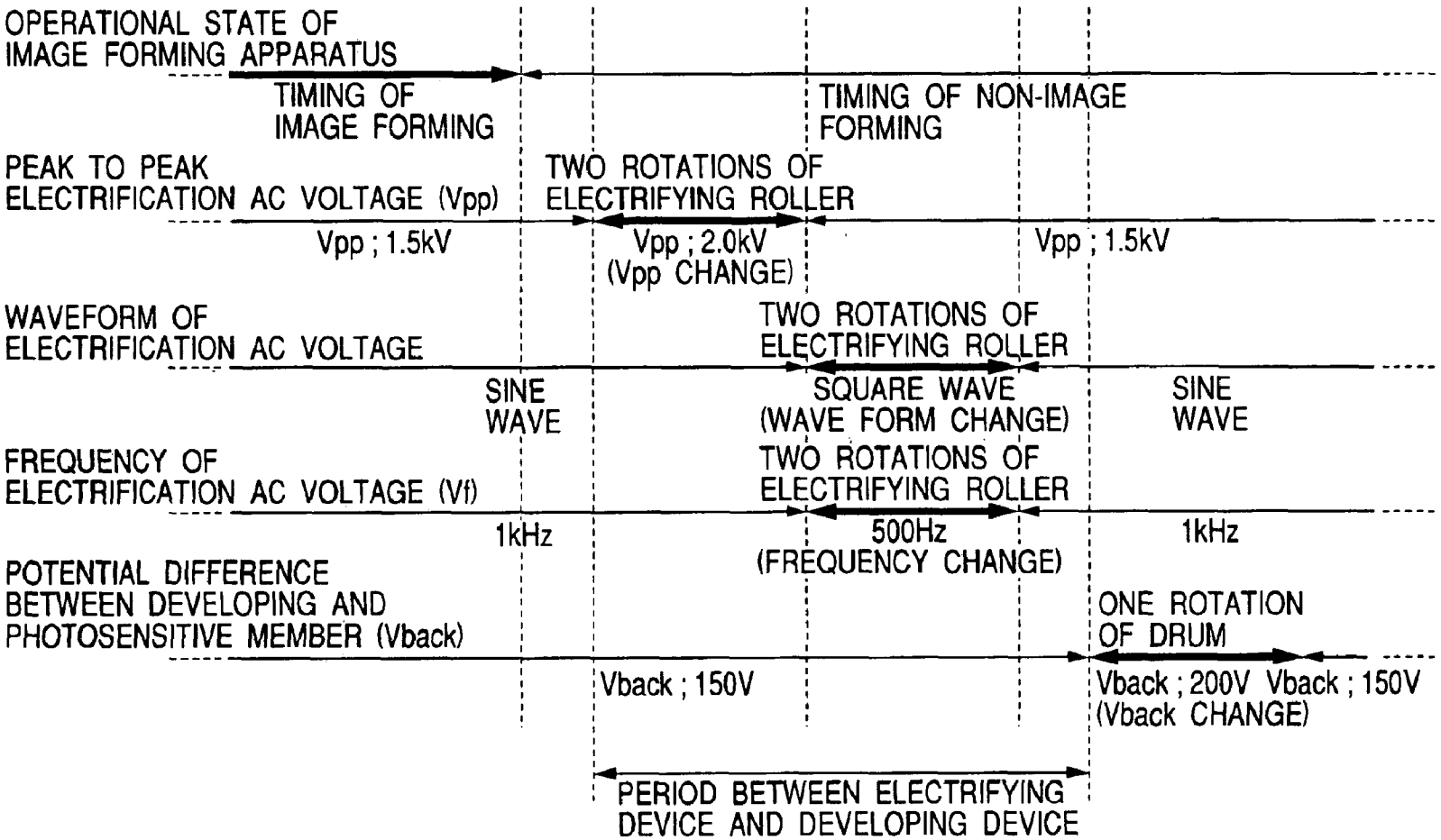
FIG. 8 is a timing chart showing an embodiment of a timing at which there is performed an operation for changing conditions concerning voltages applied to the electrifying roller and the developing sleeve in accordance with the present invention.

Control according to the present invention will be described in more detail below. FIG. 8 shows operation timings for changing the condition concerning the voltage applied to the electrifying roller 2 and for changing the potential difference between the developing sleeve 4*b* and the photosensitive drum 1 in this embodiment. (I) First, an operation for discharging the transfer residual toner adhering onto the electrifying roller 2 will be described.

Figure 3A:
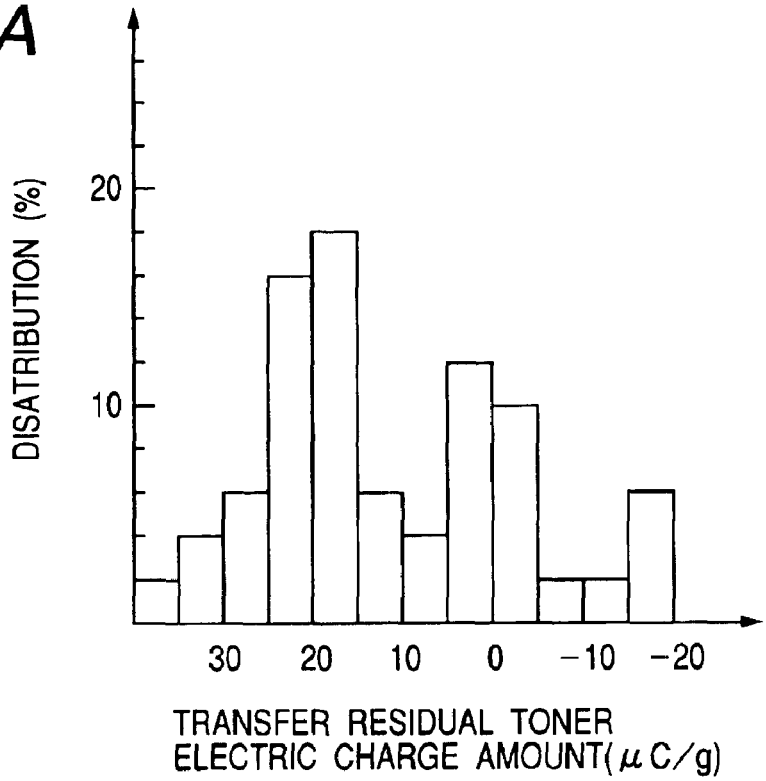
FIG. 3A is a graph illustrating the electric charge amount distribution of transfer residual toner adhering to the electrifying roller before diselectrification processing.

FIG. 3A is a relational drawing concerning the electric charge amount distribution of transfer residual toner adhering to the electrifying roller 2 when images with high printing ratios are printed in succession. As can be seen from FIG. 3A, the transfer residual toner adhering onto the electrifying roller 2 contains a large quantity of reversed toner (having the positive polarity).

In view of this fact, in this embodiment, first, the peak to peak voltage value of an alternating-current voltage applied to the electrifying roller 2 is set at 1.5 kV during image forming. However, during the post-rotation after the image forming, the peak to peak voltage value is changed to 2.0 kV, thereby accelerating the diselectrification of the transfer residual toner adhering to the electrifying roller 2. In this embodiment, while the electrifying roller 2 is making two rotations, the peak to peak voltage of the alternating-current voltage is changed (FIG. 8).

Figure 3B:
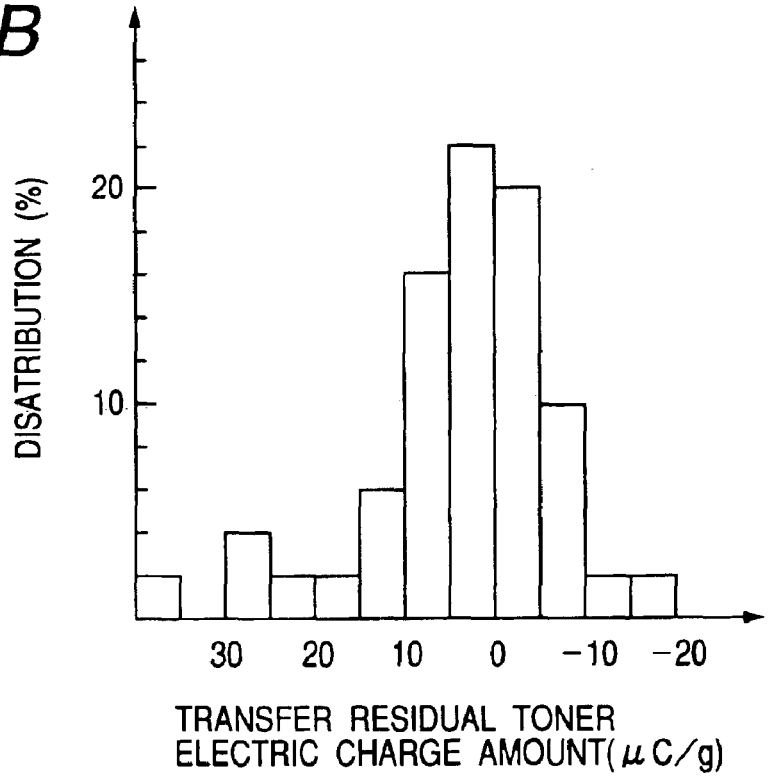
FIG. 3B is a graph illustrating the electric charge amount distribution of the transfer residual toner adhering to the electrifying roller after the diselectrification processing.

As a result of this operation, as shown in FIG. 3B, the electric charge amount distribution of the transfer residual toner adhering to the electrifying roller 2 is aligned with around 0 $\mu$C/g, so that there is lowered the mirroring force, which is to say the adhesive power, of the transfer residual toner to the electrifying roller 2.

It is preferable that the peak to peak voltage of the alternating-current voltage applied to the electrifying roller 2 is changed within a range in which the peak to peak voltage is 1.1 to 2.0 times as high as that during the image forming. If the peak to peak voltage is increased to more than 2.0 times as high as that during the image forming, a discharge product is generated in great quantity, so that there occurs faulty images or the lifespan of the photosensitive drum 1 is extremely shortened because the photosensitive drum 1 is damaged.

Also, if the peak to peak voltage is less than 1.1 times as high as that during the image forming, there is weakened the effect of promoting the diselectrification of the transfer residual toner.

Next, although the voltage waveform and waveform frequency of the alternating-current voltage applied to the electrifying roller 2 are respectively a sine wave and 1 kHz during image forming, the voltage waveform and the waveform frequency are respectively changed to a square wave and 500 Hz during the post-rotation after the image forming. In this embodiment, the voltage waveform and the waveform frequency are simultaneously changed after the peak to peak voltage changed in the manner described above during the post-rotation after the image forming is returned to 1.5 V for the image forming. Also, the voltage waveform and the waveform frequency are changed while the electrifying roller 2 is making two rotations (FIG. 8).

Figure 4:
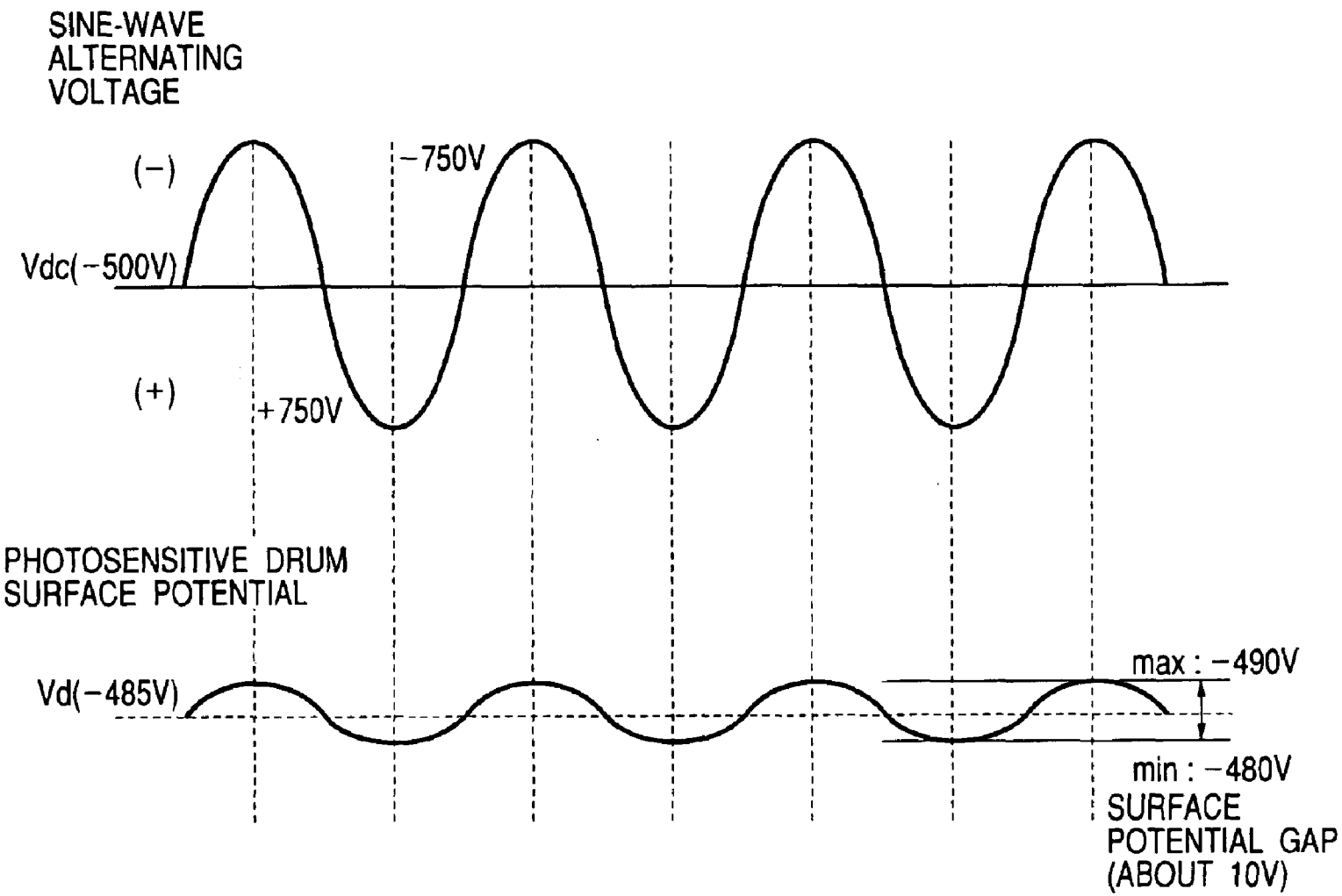
FIG. 4 is a drawing illustrating a relation between an alternating-current voltage waveform (sine wave, 1 kHz) applied to the electrifying roller and a photosensitive drum surface potential.

In more detail, during usual image forming, that is, when the alternating-current voltage applied to the electrifying roller 2 is a sine wave and 1 kHz, the potential of the surface of the photosensitive drum 1 comparatively follows the electrifying roller 2 as shown in FIG. 4.

Figure 5:
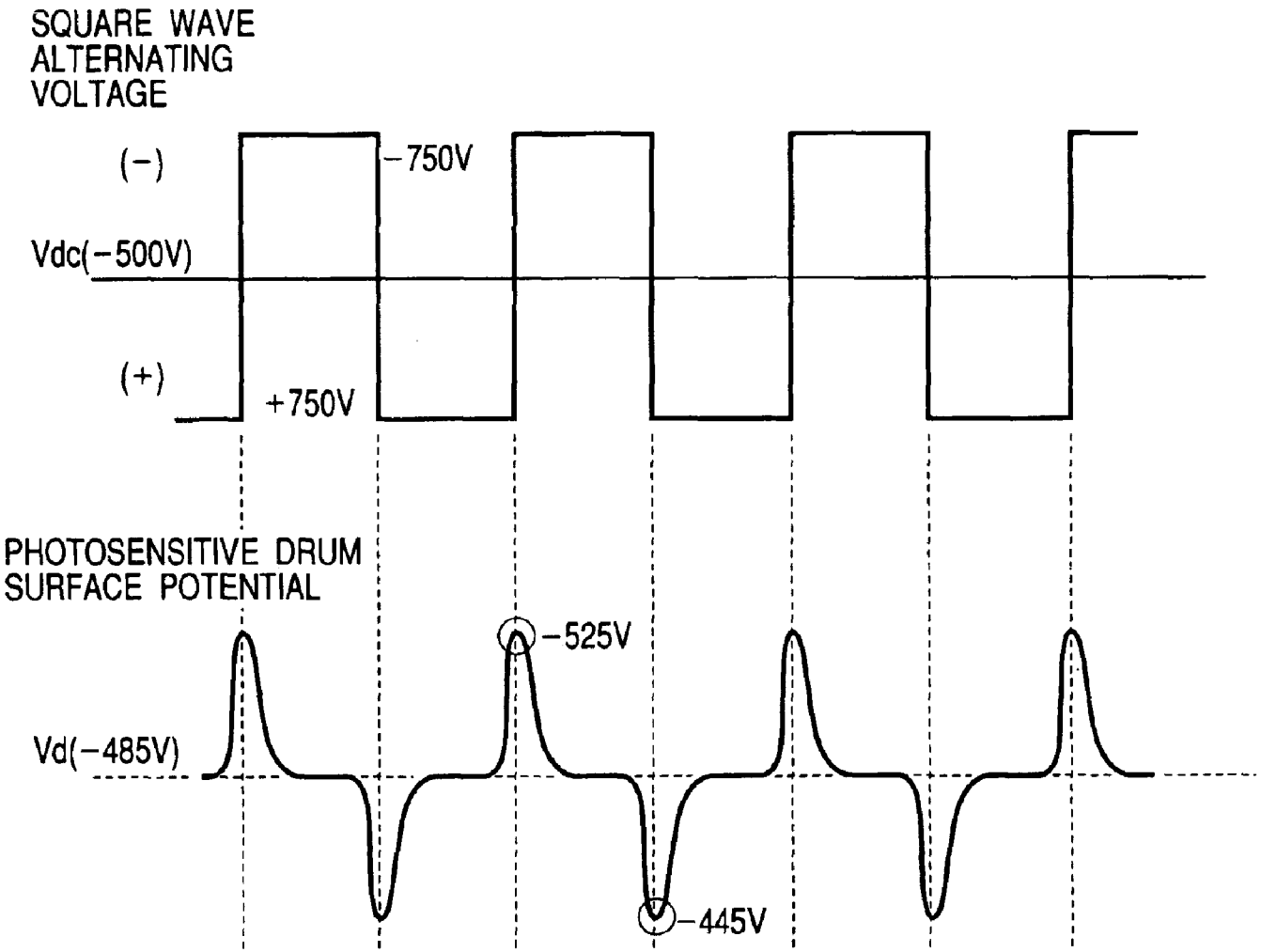
FIG. 5 is a drawing illustrating a relation between an alternating-current voltage waveform (square wave, 1 kHz) applied to the electrifying roller and the photosensitive drum surface potential.

On the other hand, by changing the voltage waveform of the alternating-current voltage from a sine wave to a square wave, an excess current temporarily flows to the photosensitive drum 1 at a timing at which the polarity of the alternating-current voltage is switched, so that there occurs periodical unevenness of the potential of the surface of the photosensitive drum 1, as shown in FIG. 5. In this embodiment, when the direct-current voltage applied to the electrifying roller 2 is 500 V, the potential of the surface of the photosensitive drum 1 varies within a range of from −525 V to −445 V. During this variation, by utilizing the potential difference between the potential of the surface of the electrifying roller 2 and the potential of the surface of the photosensitive drum 1, it becomes possible to discharge the transfer residual toner, in which toner having the negative polarity and toner having the positive polarity coexist and which adheres onto the electrifying roller 2, to the surface of the photosensitive drum 1.

Figure 6:
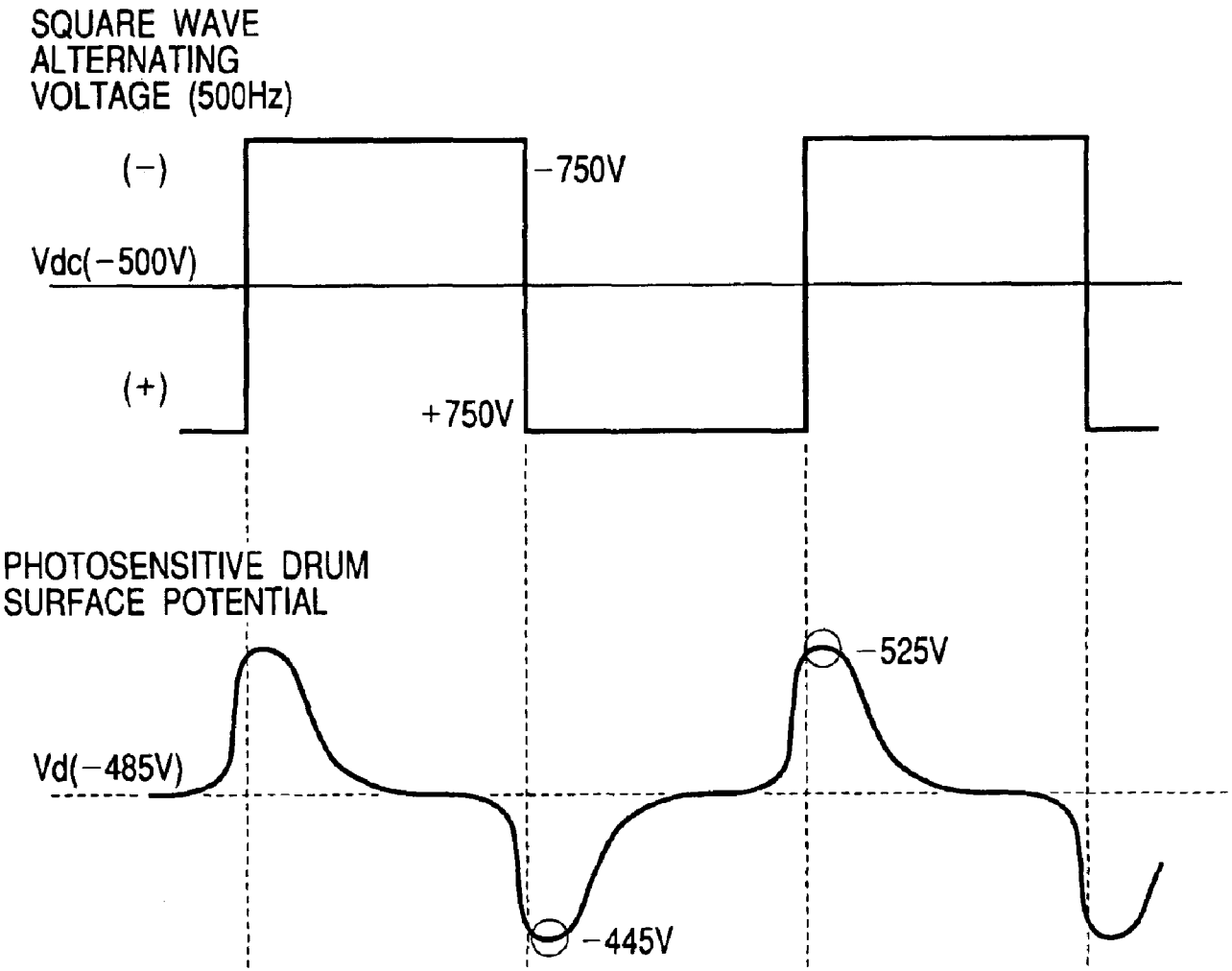
FIG. 6 is a drawing illustrating a relation between an alternating-current voltage waveform (square wave, 500 Hz) applied to the electrifying roller and the photosensitive drum surface potential.

Further, by switching the waveform frequency of the alternating-current voltage from 1 kHz to 500 Hz, it becomes possible to elongate a time period, during which the potential of the surface of the photosensitive drum 1 becomes −525 V or −445 V, as shown in FIG. 6. As a result, there is enhanced the discharging efficiency.

It is preferable that the waveform frequency changes within a range in which the waveform frequency becomes 0.2 to 0.9 times as high as that during the image forming. If the waveform frequency is less than 0.2 times as high as that during the image forming, the potential of the surface of the photosensitive drum 1 is lowered too much with reference to a target potential, so that there is a fear that there occurs the leakage of toner or magnetic particles from the developing apparatus 4. Also, if the waveform frequency is more than 0.9 times as high as that during the image forming, there is weakened the effect of enhancing the discharging efficiency.

By doing so, it becomes possible to discharge the transfer residual toner temporarily adhering to the electrifying roller 2 to the photosensitive drum 1 and to maintain a state where no adherent exists on the surface of the electrifying roller 2.

It should be noted here that this embodiment is not limited to the aforementioned operation where all of the peak to peak voltage value, voltage waveform, and waveform frequency of the alternating-current voltage applied to the electrifying roller 2 are changed. That is, it is possible to use a construction where at least one of them is changed. (II) Next, the removal and recovery of the transfer residual toner by the developing apparatus 4 will be described.

The transfer residual toner returned from the electrifying roller 2 onto the photosensitive drum 1 by the discharging operation described above is removed and recovered by the developing apparatus 4 afterwards. In this embodiment, during the post-rotation after the image forming, in synchronization with the start of the discharging operation of the electrifying roller 2 (for changing the peak to peak voltage of the alternating-current voltage applied to the electrifying roller 2), that is, in synchronization with a timing at which the changing start point of the peak to peak voltage of the alternating-current voltage on the electrifying roller 2 reaches the developing portion c, the potential difference (fog removal potential difference Vback) between the potential on the developing sleeve 4*b* of the developing apparatus 4 and the potential on the photosensitive drum 1 is changed from 150 V for the image forming to 200 V (FIG. 8). In this embodiment, the direct-current voltage applied to the developing sleeve 4*b* is changed from −350 V for the image forming to −300 V, thereby changing the fog removal potential difference Vback. By doing so, it becomes possible to enhance the recovery efficiency concerning the transfer residual toner.

In this embodiment, the timing at which this fog removal potential difference Vback is changed becomes a timing following the timing at which the waveform and waveform frequency of the alternating-current voltage applied to the electrifying roller 2 are respectively returned to those during the image forming. Also, the fog removal potential difference Vback is changed at least during a period taken by the photosensitive drum 1 to make one rotation.

Figure 7:
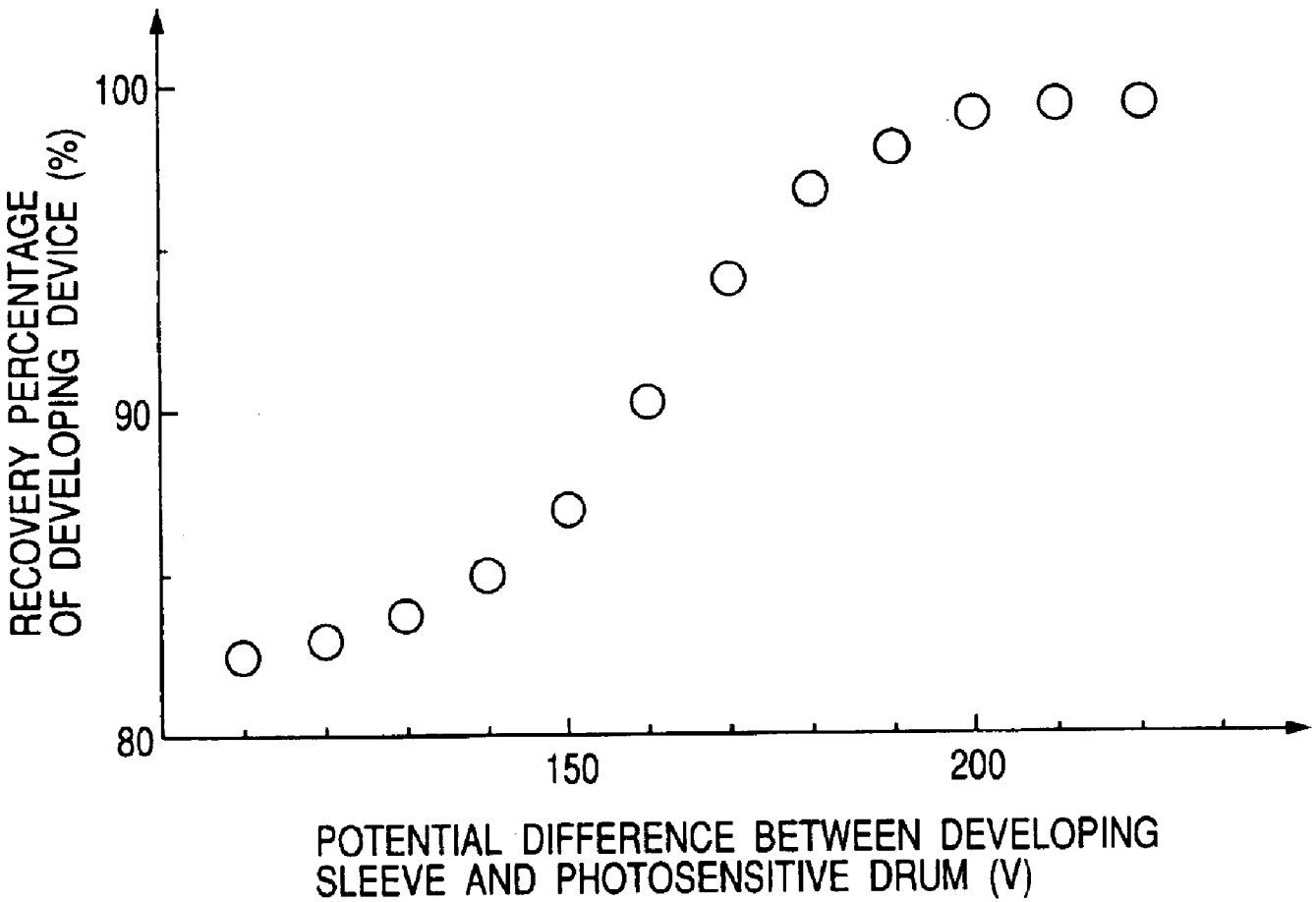
FIG. 7 is a graph illustrating a relation between (i) a potential difference between a developing sleeve and the photosensitive drum and (ii) a recovery percentage of the transfer residual toner at the developing apparatus.

FIG. 7 shows a relation between (i) the potential difference (fog removal potential difference Vback) between the developing sleeve 4*b* and the photosensitive drum 1 and (ii) the recovery percentage with which the developing apparatus 4 recovers the transfer residual toner discharged onto the photosensitive drum 1. As can be seen from FIG. 7, when the potential difference (fog removal potential difference Vback) between the developing sleeve 4*b* and the photosensitive drum 1 becomes at least equal to around 190 V, the recovery efficiency is enhanced and stabilized.

It is preferable that the fog removal potential difference Vback is changed within a range in which the potential difference becomes 1.1 to 2.0 times as large as that during the image forming. If the fog removal potential difference Vback is more than 2.0 times as large as that during the image forming, there is a fear that magnetic particles within the developing apparatus 4 leak onto the photosensitive drum 1. On the other hand, if the fog removal potential difference Vback is less than 1.1 times of that during the image forming, there is weakened the effect of enhancing the recovery efficiency concerning the transfer residual toner.

Hereupon, the potential difference between the developing sleeve 4*b* and the photosensitive drum 1 (fog removal potential difference Vback) during the image forming is changed so as to be different from that during the removal and recovery of the transfer residual toner. This is because the transfer residual toner to be recovered has various electric charge amounts. In this embodiment, as described above, as a result of the operations of the transfer residual toner unifying means 8, the toner electrification amount control means 7, and the electrifying roller 2, the electric charge amount of the transfer residual toner passing through the charging portion a becomes −30 $\mu$C/g during the image forming. On the other hand, during non-image forming, in this embodiment, the electric charge amount of the transfer residual toner discharged from the electrifying roller 2 during the post-rotation after the image forming are aligned with around 0 $\mu$C/g.

As described above, with the technique of this embodiment, the condition (high-voltage condition) of a voltage applied to the electrifying roller 2 during the post-rotation operation after the image forming is changed so as to be different from the condition of the voltage applied to the electrifying roller 2 during the image forming. As a result, it becomes possible to discharge the transfer residual toner, which adheres to the electrifying roller 2, onto the photosensitive drum 1 and to prevent a situation where the transfer residual toner is accumulated on the electrifying roller 2. Also, the condition (high-voltage condition) concerning a voltage applied to the developing sleeve 4*b* during the post-rotation after the image forming is changed so as to be different from the condition of the voltage applied to the developing sleeve 4*b* during the image forming. As a result, it becomes possible to enhance the efficiency in removal and recovery of the transfer residual toner by the developing means 4*b* and to prevent the following rotation of the transfer residual toner on the photosensitive drum 1.

As a result, even in the case where a large quantity of transfer residual toner is generated at a time as a result of an operation for successively forming images having high printing ratios, such as photographic images, a system that performs multiplex developing on a photosensitive member in an image forming apparatus that is capable of forming a color image, and the like, it is possible to prevent the adhesion of the transfer residual toner to the electrifying roller 2 or the following rotation of the transfer residual toner on the photosensitive drum 1. As a result, it becomes possible to prevent faulty images due to poor electrification resulting from the transfer residual toner and also to make use of the advantage of the cleanerless system.

It should be noted here that the timing, at which the condition concerning the voltage applied to the charging roller 2 and the fog removal potential difference Vback are changed, is not limited to the timing of this embodiment shown in FIG. 8. That is, the operation for changing the peak to peak voltage, voltage waveform, waveform frequency of the alternating-current voltage applied to the electrifying roller 2 and the operation for changing the fog removal potential difference may be successively performed in this order at predetermined timings of non-image forming. Alternatively, it is possible to simultaneously perform either one of these operations at a predetermined timing of non-image forming.

Second Embodiment

Next, another example of the present invention will be described. The fundamental construction of an image forming apparatus (printer) of this embodiment is the same as that of the first embodiment. Accordingly, the construction elements having the same functions and constructions as those of the printer 100 in the first embodiment are given the same reference numerals and the detailed description thereof will be omitted.

In the first embodiment, during the rotation after image forming, the peak to peak voltage value, voltage waveform, and waveform frequency of the alternating-current voltage applied to the electrifying roller 2 and the potential difference (fog removal potential difference Vback) between the developing sleeve 4*b* and the photosensitive drum 1 are changed from those during the image forming. By doing so, there was prevented poor electrification caused by the stains of the electrifying roller 2 by the transfer residual toner.

However, in the case where a large number of images having high printing ratios are formed in succession, there exists no time into which there is inserted the timing at which there is performed the operation (the changing of the high-voltage condition concerning the electrifying roller 2 and the developing sleeve 4*b*) described in the first embodiment. Consequently, there is a fear that there occurs a problem that poor electrification is caused by the transfer residual toner.

In view of this problem, in this embodiment, each time a predetermined number of times of image forming is performed (each time successive image formation is repeated 100 times, in this embodiment), the operation described in the first embodiment for discharging and recovering the transfer residual toner performed during the post-rotation after the image forming is forcedly inserted.

Also, in this embodiment, at each interval between image forming, that is, at each so-called inter-paper timing, the peak to peak voltage value of an alternating-current voltage applied each time to the electrifying roller 2 is changed from 1.5 kV for image forming to 2.0 kV. By doing so, at each inter-paper timing, the transfer residual toner adhering to the electrifying roller 2 is diselectrified, thereby allowing the transfer residual toner to be carried to the photosensitive drum 1 by the rubbing force between the electrifying roller 2 and the photosensitive drum 1.

With this construction, even in the case where a large number of images having high printing ratios are formed in succession, it is possible to prevent a situation where the electrifying roller 2 is polluted with the transfer residual toner.

As described above, with the technique of this embodiment, even in the case where a large number of images having high printing ratios, such as photograph images, are formed in succession, it becomes possible to prevent the generation of faulty images due to poor electrification or the like caused by the adhesion of the transfer residual toner to the electrifying roller 2 or the following rotation of the transfer residual toner onto the photosensitive drum 1. In addition, it becomes possible to provide an image forming apparatus that utilizes the advantage of the cleanerless system.

It should be noted here that as is apparent from the embodiments described above, it is possible to arbitrarily set the predetermined timing, at which the condition concerning the voltage applied to the electrifying roller 2 and the condition concerning the voltage applied to the developing sleeve 4*b* are changed, at a timing of non-image forming. In the first embodiment, the conditions concerning the voltages applied to the electrifying roller 2 and the developing sleeve 2 are changed during the post-rotation after the image forming, although these operations may be performed during the pre-rotation before the image forming. Also, these operations are not limited to the execution during each post-rotation or pre-rotation. That is, for instance, these operations may also be performed only after an image forming operation (for instance, the successive formation of images having high printing ratios), for which it is supposed that transfer residual toner would be generated in quantity, is performed and also only before the next image forming operation. That is, a timing, at which a cleaning sequence for the electrifying roller described above is performed in accordance with the image density data (printing ratio data), may be controlled by the CPU 500 functioning as a control means. In this case, as described in this second embodiment, these operations may be inserted into a successive image forming operation.

It should be noted here that in the second embodiment, as to the predetermined timing of non-image forming, the condition of the voltage applied to the electrifying roller 2 (in this second embodiment, only the peak to peak voltage value of the alternating-current voltage) is changed so as to be different from that during the image forming at each inter-paper timing. As described above, with the technique of the present invention, it is possible to change either one of the condition concerning the voltage applied to the electrifying roller 2 and the condition concerning the voltage applied to the developing sleeve 4*b* so as to be different from that during the image forming at a predetermined timing of non-image forming. As a result, it becomes possible to obtain each effect described above.

Accordingly, it becomes possible to prevent a situation where developer staying on an image bearing member after a transferring step adheres to and is accumulated on an electrifying means irrespective of the printing ratio and the like of an image, to enhance the recovery efficiency of the staying developer by a developing means, to prevent poor electrification and faulty images, and to make use of the advantage of the cleanerless system.

Third Embodiment

Figure 9:
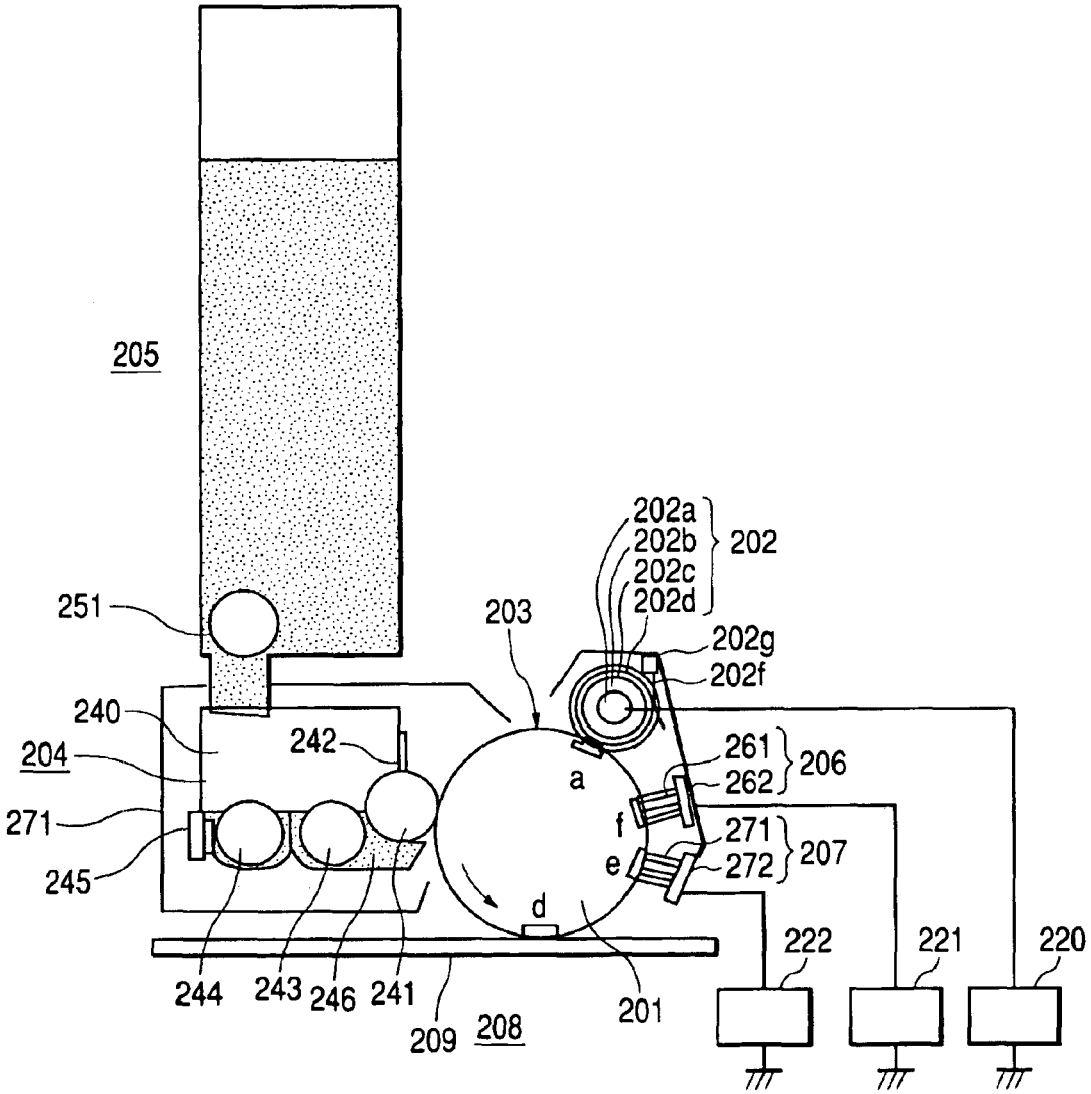
FIG. 9 is a cross-sectional view showing an outline of an image forming apparatus of a third and fourth embodiments.
Figure 10:
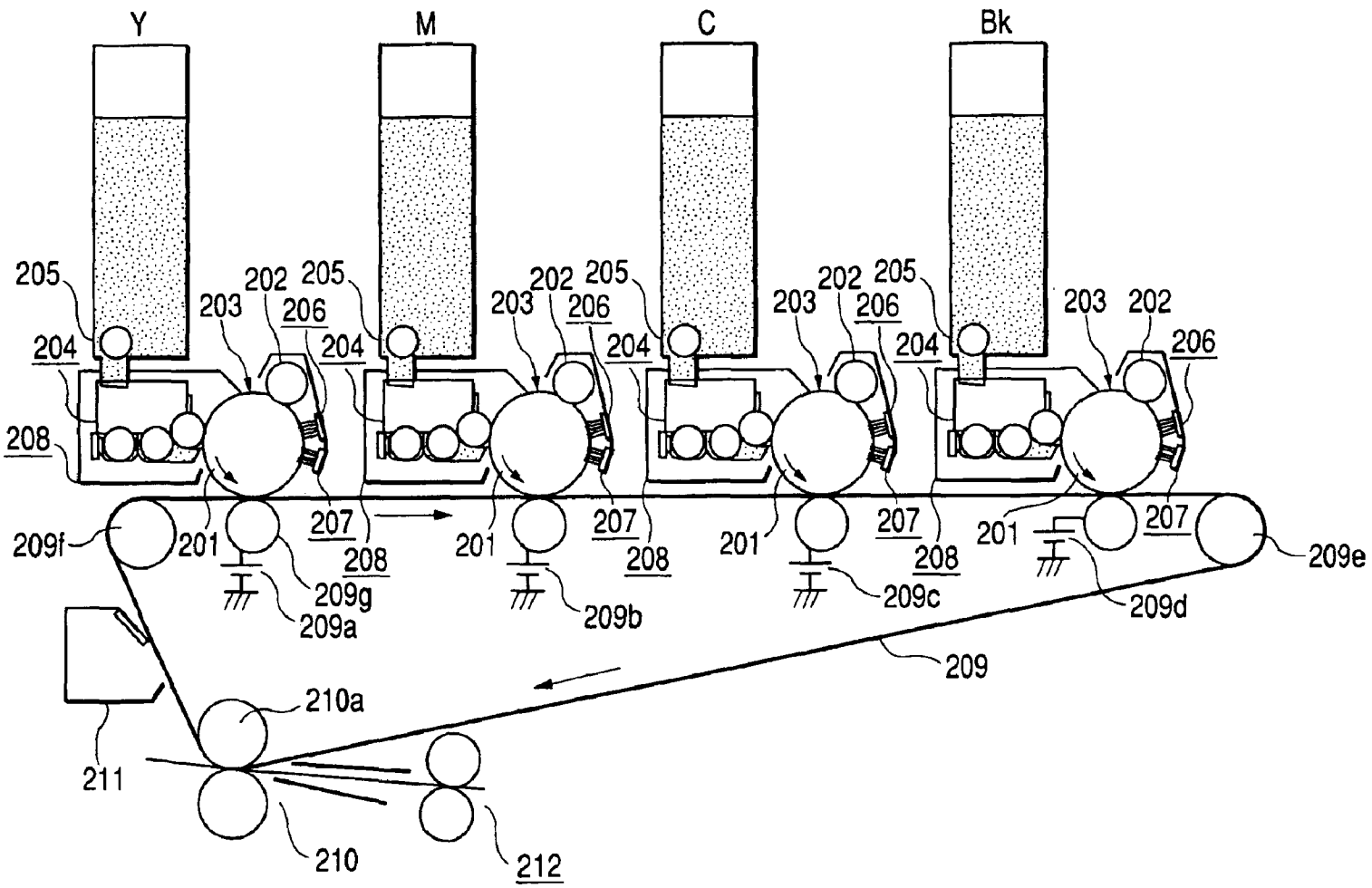
FIG. 10 is also a cross-sectional view showing the outline of the image forming apparatus of the third and fourth embodiments.

Still another embodiment according to the present invention will be described below. FIGS. 9 and 10 are each a drawing showing the outline of the construction of an example of an image recording apparatus according to this embodiment.

A color laser printer shown in FIG. 10 is a color laser printer that uses a transferring system electrophotographic process, a contact electrifying system, a reversal developing system, and a cleanerless system and has the maximum sheet passing size of the A3 size. This color laser printer includes a plurality of process cartridges 208 (hereinafter referred to as "P-CRGs"). This color laser printer is also a four serial drum system (in-line) printer that first successively performs multiple-transferring onto an intermediate transferring belt 209 that is a second image bearing member and then obtains a full-color printed image.

In FIG. 10, an intermediate transferring belt 209 (transferring medium) with no end is stretched by a driving roller 209*e*, a tension roller 209*f*, and a second transferring opposing roller 210*a*, and is rotated in a direction indicated by an arrow in the drawing.

Four process cartridges 208 are disposed in serial with reference to the above-described intermediate transferring belt 209 in the order of yellow, magenta, cyan, and black.

The P-CRGs 208 will be described below with reference to FIG. 9.

In the P-CRG 208 for developing yellow toner, reference numeral 201 denotes an electrophotographic photosensitive member (photosensitive drum) of rotary drum type functioning as an image bearing member. This photosensitive drum 201 is an organic photoconductive body (OPC) drum whose outer diameter is 50 mm. Also, the photosensitive drum 201 is rotationally driven about a center spindle at a process speed (circumferential speed) of 100 mm/sec in a clockwise direction indicated by an arrow. The photosensitive drum 201 has a construction where three layers that are an underlying layer for suppressing the interference of light and improving the adhesive property of an upper layer, a photocharge generating layer, and a charge transporting layer (whose thickness is 20 $\mu$m) are applied so as to be stacked on the surface of a cylinder (conductive drum base) made of aluminum in this order.

In an electrifying step, a voltage under a predetermined condition is applied to an electrifying roller 202 functioning as a contact electrifier, thereby uniformly electrifying the surface of the photosensitive drum 201 to have the negative polarity. The longitudinal length of the electrifying roller 202 is 320 mm. Also, the electrifying roller 202 has a three-layer construction where a lower layer 202*b*, an intermediate layer 202*c*, and a surface layer 202*d* are stacked in this order around the outside of a metal core (supporting member) 202*a*. The lower layer 202*b* is a foamed sponge layer for reducing an electrifying sound. The intermediate layer 202*c* is a resistance layer for obtaining uniform resistance across the whole surface of the electrifying roller. The surface layer 202*d* is a protective layer that is provided in order to prevent the occurrence of leakage even in the case where a defect, such as a pinhole, exists on the photosensitive drum 201. The electrifying roller 202 of this embodiment has a construction where a stainless round bar with a diameter of 6 mm is used as the metal core 202*a*, a layer obtained by dispersing carbon in fluororesin is used as the surface layer, the outer diameter as a roller is 14 mm, and the roller resistance is $10^4$ Ω to $10^7$ Ω.

Both the end portions of the metal core 202*a* of this electrifying roller 202 are respectively held by bearing members so as to be freely rotated. In addition, this metal core 202*a* is energized toward the photosensitive drum 201 by a pressure spring and is brought into press-contact with the surface of the photosensitive drum 201 with a predetermined pressing force. With this construction, the electrifying roller 202 is rotated by following the rotation of the photosensitive drum 201. Also, a predetermined oscillating voltage (bias voltage Vdc+Vac), in which a direct-current voltage from a power source 220 and an alternating-current voltage with a frequency f are superimposed on each other, is applied to the electrifying roller 202 through the metal core 202*a*. In this manner, the peripheral surface of the rotating photosensitive drum 201 is electrified to have a predetermined potential.

In this embodiment, the bias applied to the electrifying roller during image forming is an oscillating voltage where a direct-current voltage of −500V and an alternating-current voltage having a frequency f of 1150 Hz, a peak to peak voltage Vpp of 1400 V, and a sine-wave are superimposed on each other. With this bias, the peripheral surface of the photosensitive drum 201 is uniformly contact-electrified to have a potential of −500 V (dark potential Vd).

In FIG. 10, reference numeral 202*f* denotes an electrifying roller cleaning member that is a cleaning film having flexibility in this embodiment. This cleaning film 202*f* is disposed parallel to the longitudinal direction of the electrifying roller 202. In addition, one end of the cleaning member 202*f* is fixed to a supporting member 202*g* that reciprocates by a fixed amount with reference to the longitudinal direction. Further, the cleaning member 202*f* is disposed so that a contact nip with the electrifying roller 202 is formed on a surface in proximity to a free end side. The supporting member 202*g* is driven by a drive motor of the printer through a gear train so as to reciprocate in the longitudinal direction by a fixed amount. As a result, the surface 202*d* of the electrifying roller is rubbed by the cleaning film 202*f*. As a result of this rubbing, the adhesive contaminants (such as particulate toner or external additives) on the surface 202*d* of the electrifying roller are removed.

After the uniform electrification processing to a predetermined polarity and potential by the electrifying roller 202, by receiving image exposure light 203 from an unillustrated image exposure means (a color separation/image-forming and exposing optical system for a color original image, a scanning exposing system performing laser scanning where there is outputted a laser beam modulated in accordance with a time-series electric digital pixel signal of image information, or the like), there is formed an electrostatic latent image corresponding to a first color component image (yellow component image) in an intended color image. In this embodiment, a laser beam scanner using a semiconductor laser is used as an exposing apparatus, and performs laser scanning exposure (image exposure) on a uniformly electrified surface of the rotating photosensitive drum 201 by outputting laser light modulated in accordance with an image signal sent from an unillustrated host apparatus, such as an image reading apparatus, to the printer side. By means of this laser scanning exposure, there is lowered the potential in each portion of the surface of the photosensitive drum 201 irradiated with the laser light. As a result, an electrostatic latent image corresponding to the image information that has been scanned and exposed is formed on the surface of the rotating photosensitive drum 201. In this embodiment, the potential in each exposed portion is set at −150 V.

Next, the electrostatic latent image is developed by the first developer 204 (yellow developer) using yellow toner that is the first color.

Here, the developer 204 will be described with reference to FIG. 9.

The developer 204 is a two-component contact developing apparatus (two-component magnetic brush developing apparatus). Reference numeral 240 denotes a developing container and reference numeral 241 represents a non-magnetic developing sleeve that includes an unillustrated magnet roller that is disposed so as to be fixed inside thereof. A part of the outer peripheral surface of this developing sleeve 241 is exposed to the outside. Also, the developing sleeve 241 is disposed so as to be rotated within the developing container 240. Reference numeral 242 indicates a developer regulating blade, numeral 246 two-component developer that is a mixture of toner and magnetic carrier contained within the developing container 240, and numerals 243 and 244 developer agitating members disposed on the bottom portion side within the developing container 240.

The developing sleeve 241 is provided with the developer regulating blade 242 so that there is maintained a predetermined distance, and forms a developer thin layer on the developing sleeve 241 in accordance with the rotation of the developing sleeve 241 in a direction of arrow C.

The developing sleeve 241 is disposed so as to closely oppose the photosensitive drum 201 by maintaining the closest distance (referred to as the "S-Dgap") with the photosensitive drum 201 at 350 μm. A portion in which the photosensitive drum 201 and the developing sleeve 241 oppose each other is a developing portion. The developing sleeve 241 is rotationally driven in the developing portion in a direction opposite to a direction in which the photosensitive drum 201 advances. The developer thin layer on the developing sleeve 241 contacts the surface of the photosensitive drum 1 in the developing portion c and rubs the photosensitive drum surface in moderation. To the developing sleeve 241, there is applied a predetermined developing bias from an unillustrated power source. In this embodiment, the developing bias voltage applied to the developing sleeve 241 is an oscillating voltage where a direct-current voltage (Vdc) and an alternating-current voltage (Vac) are superimposed on each other. In more detail, the developing bias voltage is an oscillating voltage where a direct-current voltage of −350 V and an alternating-current voltage of 1800 V having a frequency of 2300 Hz are superimposed on each other.

The toner in the developer coated as a thin layer on the surface of the rotating developing sleeve 241 and carried to the developing portion in this manner selectively adheres to the surface of the photosensitive drum 201 in accordance with the electrostatic latent image by an electric field generated by the developing bias. In this manner, the electrostatic latent image is developed as a toner image. In the case of this embodiment, toner adheres to an exposed light portion of the surface of the photosensitive drum 1 and the electrostatic latent image is reversal-developed.

The developer thin layer on the developing sleeve 241 having passed through the developing portion returns to the developer reserving portion in the developing container 240 in accordance with the continuing rotation of the developing sleeve.

Within the developer 204, there are provided agitating screws 243 and 244 for agitating developer. These screws are rotated in synchronization with the rotation of the sleeve and have a function of agitating replenished toner and carrier and giving a predetermined triboelectrification to toner.

On the sidewall surface on the upstream side of the screw 244 of the developer 204, there is provided a sensor 244 for detecting the density of toner in developer by detecting the changing of the magnetic permeability of the developer. Also, a toner replenishing opening is provided on the somewhat downstream side of the sensor 244. After a developing operation is performed, the developer is carried to the sensor 244 portion, at which the toner density is detected. In order to have the toner density in the developer remain constant in accordance with a result of the detection, toner replenishment is performed through the opening 246 of the developer 204 from a developer supplying unit (hereinafter referred to as the "T-CRG") 205 by the rotation of a screw 251 within the T-CRG 205 as appropriate. The replenished toner is carried by the screw 244, is mixed with carrier, and is given appropriate triboelectrification. Following this, the toner is carried to the vicinity of the sleeve 241, is converted into a thin layer on the developing sleeve 241, and is applied to developing.

In this embodiment, negatively electrified toner having an average particle diameter of 6 $\mu$m is used as the toner. Also, magnetic carrier having saturation magnetization of $20^5$ emu/cm$^3$ and an average particle diameter of 35 $\mu$m is used as the carrier. Further, a mixture, in which the toner and carrier are mixed at a weight ratio of 6:94, is used as the developer.

Also, the electrification amount of toner developed on the photosensitive drum is −25 $\mu$C/g.

In FIG. 10, the yellow image formed on the photosensitive drum 201 rushes to a primary transferring nip portion with an intermediate transferring belt 209. In the transferring nip portion, a transferring roller 209*g* is abutted against the underside of the intermediate transferring belt 209. The transferring roller 209*g* includes primary transferring bias sources 209*a* to 209*d* in order to make it possible to independently apply a bias at each port. The intermediate transferring belt 209 first transfers yellow toner at a port for the first color. Then, the intermediate transferring belt 209 performs multiplex transferring at each port in each color of magenta, cyan, and black in succession from the photosensitive drum 201 corresponding to each color having undergone the same processing as above.

In this embodiment, by paying attention to the transferring efficiency concerning toner developed in an exposing portion V1 portion (whose potential is −150 V), a voltage of +350 V is applied as a primary transferring bias for all colors from the first color to the fourth color. A full-color image formed using four colors on the intermediate transferring belt 209 is next transferred onto a transferring material P sent from the feed roller 212 by a secondary transferring roller 210 by one operation and is melted and fixed by an unillustrated fixing apparatus. In this manner, there is obtained a color print image.

The secondary transfer residual toner residing on the intermediate transferring belt 209 undergoes blade cleaning by an intermediate transferring belt cleaner 211, thereby making a preparation for the next image forming step. As to the selection of the material of the transferring belt 209, it is not preferable that there is used an expansion material because it is required to enhance the registration at each color port. Therefore, it is preferable that there is used a resin-based belt, a rubber belt containing a metal core body, or a belt obtained by combining a resin with rubber.

In this embodiment, there is used a resin belt obtained by dispersing carbon in PI (polyimide) so that its volume resistivity is controlled in $10^8$ Ωcm order. The resin belt has a thickness of 80 $\mu$m, a longitudinal length of 320 mm, and a whole circumference of 900 mm.

Also, the transferring roller 209*g* is made of a conductive sponge. The resistance, outside diameter, and longitudinal length of the transferring roller 209*g* are $10^6$ Ωcm or less, 16 mm, and 315 mm, respectively.

In FIG. 9, a toner electrification control means 206 and a residual toner image unifying means 207 are abutted against the photosensitive drum 201. In this embodiment, both of these means use a brush member made of conductive fibers. In more detail, the toner electrification control means 206 has a construction where an electrode plate 262 that is horizontally long is provided with a brush portion 261. In a like manner, the residual toner unifying means 207 has a construction where an electrode plate 272 is provided with a brush portion 271. Also, the brush portions 261 and 271 are abutted against the surface of the photosensitive drum 201. In this manner, these brush portions are disposed so as to be fixed and supported. The resistance values of the brush portions 261 and 271 are controlled by mixing carbon or metal powder in fibers made of rayon, acrylic, polyester, or the like. As to the brush portions 261 and 271, in order to establish uniform contact with the photosensitive drum surface and transfer residual toner, it is preferable that their gauges are 30 denier or less and their densities are ten to five hundred thousands/inch$^2$ or higher. In this embodiment, each of the brush portions 261 and 271 has a gauge of six denier, a density of one hundred thousands/inch$^2$, a fiber length of 5 mm, and a brush resistance of $6\times10^3$ Ω·cm. These toner electrification control means 206 and residual toner unifying means 207 are abutted so that the brush portions 261 and 271 have an intrusion amount of 1 mm with reference to the surface of the photosensitive drum 1 and the width of their abutting nip portions with the photosensitive drum 201 is 5 mm.

By means of these two brush members, there are prevented the rushing of a large quantity of transfer residual toner, the reversed polarity toner in the transfer residual toner, and toner that has not been sufficiently electrified to the normal polarity to the electrifying roller. As a result, there is prevented the occurrence of stains on the electrifying roller.

Concrete operations of these two brushes (the residual toner unifying means 207 and the toner electrification amount control means 206) will be described below.

The residual toner unifying means 207 and the toner electrification amount control means 206 are provided in this order from the upstream side in the drum rotation direction at a position that is on the downstream side of the transferring portion d in the photosensitive drum rotation direction and on the upstream side of the charging portion a. By means of these means, the transfer residual toner on the photosensitive drum 201 is unified and the electrification polarities of the transfer residual toner are aligned with the negative polarity that is the normal polarity.

A voltage having the positive polarity (positive bias) is applied to the residual toner unifying means 207 by a power source 222. In this embodiment, there is applied a voltage of 300 V. The legend "e" denotes a contact portion between the residual toner unifying means 207 and the surface of the photosensitive drum 201. This residual toner unifying means has a function of physically preventing the flowing of a large amount of transfer residual toner to the toner electrification amount control means at a time and a function of temporarily sucking toner, whose electric charge amount is zero or which has been electrified to have the negative polarity, contained in the transfer residual toner having various polarities using this residual toner unifying means 207 and gradually discharging toner reversed to the positive polarity onto the photosensitive drum. Further, the residual toner unifying means 207 plays a roll for allowing toner electrification amount control to be described later to give sufficient electric charges to toner by setting the potential on the photosensitive member at around 0 V and obtaining a potential difference with a voltage applied for the toner electrification amount control.

A voltage having the negative polarity is applied to the toner electrification amount control means 206 by a power source 221. In this embodiment, there is applied a voltage of −800 V. The legend "f" denotes a contact portion between the toner electrification amount control means 206 and the surface of the photosensitive drum 201. The electrification polarities of the transfer residual toner on the photosensitive drum 201 passing through the toner electrification amount control means 206 are aligned with the negative polarity that is the normal polarity. The toner is aligned with the positive polarity by the residual toner unifying means 207 and the potential on the photosensitive member is set at around 0 V, so that it is possible to more effectively align the electrification polarities with the negative polarity. By aligning the electrification polarities of the transfer residual toner with the negative polarity that is the normal polarity using this toner electrification amount control means 206, there is increased the mirroring force to the photosensitive drum 201 during the electrification processing of the surface of the photosensitive drum 201 from above of the transfer residual toner in the electrifying portion a that is positioned on a further downstream side. As a result, there is prevented the adhesion of the transfer residual toner to the electrifying roller 202. Therefore, the toner having passed without adhering to the electrifying roller is recovered at the developer through the cleaning simultaneous with developing.

In order to recover the transfer residual toner on the photosensitive drum 201 to the developing apparatus 204 with such a method, it is required that the toner electrification amount is appropriate.

However, in order to recover transfer residual toner, which has been significantly electrified to the negative polarity by the toner electrification amount control means 206, at the developing apparatus 204 for the sake of preventing the adhesion of toner to the electrifying roller 202 in the manner described above, it is required to perform diselectrification.

The transfer residual toner that has been significantly electrified to the negative polarity by the toner electrification amount control means 206 is ac-discharged by an alternating-current voltage (frequency f=1150 Hz, Vpp=1400 V) applied by the electrifying roller 202. As a result, the electrification amount of toner having passed through the electrifying portion a becomes approximately the same as the electric charge amount of developing toner.

Then, in a developing step, the transfer residual toner in each unexposed portion of the photosensitive drum 201, in which toner should not be developed, is completely and uniformly aligned with the negative polarity. Also, the mirroring force with the photosensitive drum 201 has been reduced through the appropriate diselectrification by the electrifying roller 202. As a result, the transfer residual toner is recovered into the developer with reliability by the relation between the aforementioned drum potential of −500 V and the DC component of the developing bias that is −350 V. In this embodiment, as described above, the developing sleeve 241 of the developing apparatus 204 is rotated in a direction opposite to the advancing direction of the surface of the photosensitive drum 1 in the developing portion and this is advantageous when the transfer residual toner on the photosensitive drum 1 is recovered.

In accordance with the diversification of users' needs in recent years, there is generated a large quantity of transfer residual toner as a result of a successive printing operation of images having high printing ratios, such as photographic images, and there is increased the amount of toner accumulated on the residual toner unifying means and the toner electrification amount control means. If the printing operation is continuously repeated under such a state, there occurs the lowering of the function of the developer electrification amount control means and the shortage of an electrification force. If toner that has not been sufficiently electrified to have the negative polarity rushes to the electrifying portion, the electric charge amount of the toner without a sufficient electric charge amount is further reduced by the ac-discharge at the electrifying portion and adheres to the electrifying roller. As a result of the accumulation of such toner, the surface of the electrifying roller is polluted with toner. Toner has isolation property, so that the resistance of the electrifying roller surface in the toner adhering portion is increased, which results in the occurrence of an unevenly electrified image due to the poor electrification in the portion. Also, when the operation of the image forming apparatus is urgently stopped during image forming due to paper jam or the like, a similar problem occurs because developing toner existing on the photosensitive drum is not transferred and rushes to the brush portions and the electrifying roller portion.

In view of this problem, in this embodiment, in order to restore a normal state of the electrifying roller that has been polluted with toner as a result of the situation described above, there is provided an electrifying roller cleaning sequence similar to that of the embodiments described above. Note that in this embodiment, in contrast to the embodiments described above, residual toner discharged from the electrifying roller to the photosensitive drum side is carried to the transferring portion in accordance with the rotation of the photosensitive drum and is transferred onto the intermediate transferring belt during the cleaning sequence. Following this, the residual toner transferred from each photosensitive drum to the intermediate transferring belt is recovered to the intermediate transferring belt cleaning device.

The electrifying roller cleaning sequence will be described in detail with reference to FIG. 11. Note that this cleaning sequence is carried out during a non-image forming period (a certain period of non-image forming). In this embodiment, the cleaning sequence is carried out at an inter-paper timing, during a preparation rotation period before the image forming (a period from the input of an image forming start signal to the completion of the preparation for image forming), and a post-rotation period after the image forming.

The bias applied to the electrifying roller during the cleaning sequence is a sine wave having a peak to peak voltage of 1800 Vpp that is larger than the peak to peak voltage (=1400 Vpp) of an alternating-current voltage applied to the electrifying roller during the image forming by 400 Vpp. The frequency of the applied bias is 1150 Hz that is the same as that during the image forming. A time period, during which this cleaning sequence is being carried out, is at least equal to a time period taken by the electrifying roller to make one rotation, and it is possible to further elongate this time period in accordance with how much degree the electrifying roller is stained. In this embodiment, during pre-rotation, the cleaning sequence is carried out while the electrifying roller is making four rotations. Also, during inter-paper period, the cleaning sequence is carried out while the electrifying roller is making one rotation. Further, during post-rotation, the cleaning sequence is carried out while the electrifying roller is making five rotations.

By applying a peak to peak voltage that is higher than the alternating-current voltage applied to the electrifying roller during image forming in this manner, there is increased the oscillating electric field acting between the photosensitive drum and the electrifying roller and there appears a strong peeling-off effect for toner having both polarities and external additives adhering to the electrifying roller. once the adherents have been peeled off, they adhere onto the photosensitive drum, are transferred onto the intermediate transferring belt through press-contact transferring, and are recovered by a cleaning blade provided for the intermediate transferring belt. A voltage of 350 V that is approximately the same as the voltage applied during image forming is applied to the transferring member, thereby actively transferring toner having the negative polarity. The reversed toner having the positive polarity resides on the photosensitive drum. However, by respectively applying voltages of 300 V and −800 V that are the same as those applied during image forming to the residual toner unifying means and the toner electrification amount control means and further by setting the direct-current voltage applied to the electrifying roller at −500 V that is the same as that applied during the image forming, it becomes possible to sufficiently electrify residing reversed toner that has not been transferred to have the negative polarity by the two brush members. As a result, the residing toner passes through the electrifying portion without adhering to the electrifying roller, is transferred to the intermediate transferring belt during the next transferring operation, and is recovered by the, intermediate transferring belt cleaner.

During the cleaning sequence, in order to prevent the adhesion of developer to the photosensitive drum, the rotation of the developing sleeve is stopped, an AC voltage is cut off, and there is applied only a direct-current voltage of −350 V that is the same as the voltage applied during image forming.

Toner that is not completely discharged from the electrifying roller onto the photosensitive drum and was left to adhere onto the electrifying roller and the like is processed so as to have a non-pattern using the distributing effect achieved by an alternating-current voltage having a high peak to peak voltage. As a result, faults of an image due to the stains on the electrifying roller become inconspicuous.

By performing the cleaning sequence described above, it becomes possible to reduce the stains on the surface of the electrifying roller 204 and to elongate the lifespan of the electrifying roller 204.

As a result, even during the successive printing of patterns having high printing ratios, such as photographic images, it is possible to prevent the occurrence of faulty images due to electrification unevenness. Also, in the case where there occurs the interruption of an image forming operation due to paper jam, a sudden power failure, or the like under a state where developing toner image adheres onto the photosensitive drum 201 and is carried to a transferring portion, it is possible to prevent the generation of faulty images due to the poor electrification during the next main body operation with the present invention.

The above description has been made based on a case where the present invention is applied to an image forming apparatus using a processing cartridge system. However, needless to say, the present invention is also applicable to an image forming apparatus that does not use the process cartridge system in a like manner.

In such an image forming apparatus that does not use the process cartridge system, it is required to use the electrifying roller 204 for a long time period in comparison with an image forming apparatus using the process cartridge system. This means that the effect of the present invention is increased in the case where the present invention is applied to such an image forming apparatus that does not use the process cartridge system.

It is possible to set the timing, at which the cleaning sequence described above is activated, in various ways. For instance, this cleaning sequence may be activated when the power source switch of the apparatus main body is turned on or after a predetermined number of images have been made. Alternatively, the cleaning sequence may be automatically activated under a stand-by state after a fixed time period has passed. Also, the cleaning sequence may be activated through the user's operation of a key provided on an operation panel of the apparatus main body.

It should be noted here that the transfer residual toner unifying means 207 and the toner electrification amount control means 206 are each a fixed brush-shaped member in this embodiment. However, each of these means may be a member having an arbitrary form, such as a brush rotating body, an elastic roller body, or a sheet-shaped member.

Also, the image bearing member may be a body having a direct injection electrification property provided with a charge injecting layer whose surface resistance is $10^9$ to $10^{14}$ Ω·cm. Even in the case where there is not used a charge injecting layer (even in the case where a charge transporting layer exists within a resistance range described above, for instance), it is possible, to obtain an equivalent effect. There may be used an amorphous silicon photosensitive member whose surface layer has a volume resistivity of around $10^{13}$ Ω·cm.

As the contact electrifying member having flexibility, in addition to the electrifying roller, it is possible to use a member having a shape and material such as a fur brush, a felt, and a cloth. Also, it is possible to obtain a member having more appropriate elasticity, conductivity, surface property, and durability through the combination of various kinds of materials.

Also, as to the waveform of an alternating-current voltage component (AC component, a voltage whose voltage value changes periodically) of an oscillating electric field applied to the contact electrifying member or the developing member, it is possible to use a sine wave, a square wave, a triangular wave, and the like as appropriate. There may be used a square wave formed by periodically turning on/off a DC power source.

Further, the image exposure means functioning as an information writing means for the electrified surface of the photosensitive member functioning as an image bearing member may be a digital exposing means using a solid state light-emitting device array such as LEDs, in addition to the laser scanning means in the embodiments. Also, the image exposure means may be an analog-fashion image exposure means whose original illuminating light source is a halogen lamp, a fluorescent lamp, or the like. In short, there occurs no problem so long as there is used a means that is capable of forming an electrostatic latent image corresponding to image information.

Fourth Embodiment

In this embodiment, there is used a main body that is the same as that of the image forming apparatus of the third embodiment.

A cleaning sequence for the electrifying roller in this embodiment will be described in detail below with reference to FIG. 12. Note that this cleaning sequence is carried out during a non-image forming period (period of non-image forming). In this embodiment, the cleaning sequence is carried out during the preparation rotation before the image forming and during rotation after the image forming.

The bias applied to the electrifying roller during the cleaning sequence is a sine wave of 1800 Vpp that is higher than the peak to peak voltage (=1400 Vpp) of the alternating-current voltage applied to the electrifying roller during the image forming by 400 Vpp and has a frequency of 1150 Hz that is the same as that during the image forming.

Voltages of 300 V and −800 V that are the same as the voltages applied during the image forming are applied to the residual toner unifying means and the toner electrification amount control means, respectively.

Figure 13:
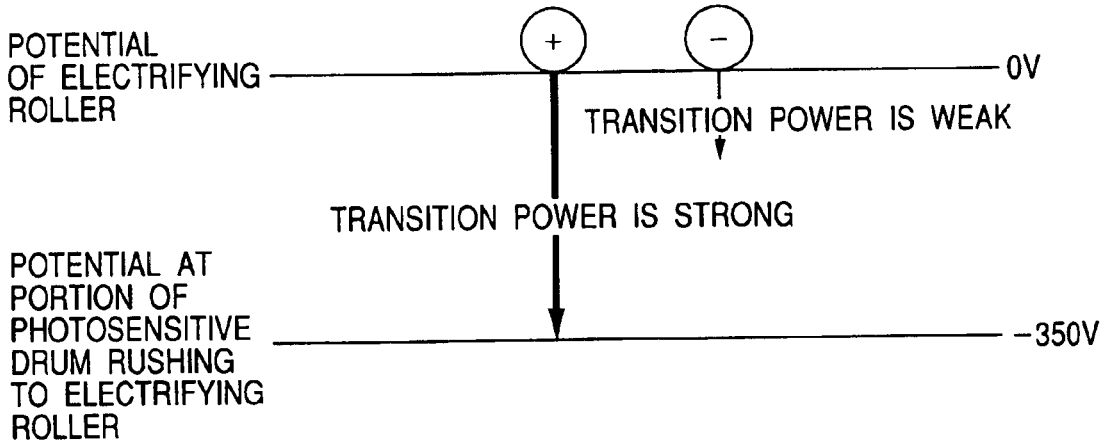
FIG. 13 is a simplified drawing showing a potential relation during the cleaning sequence of the fourth embodiment.
Figure 14:
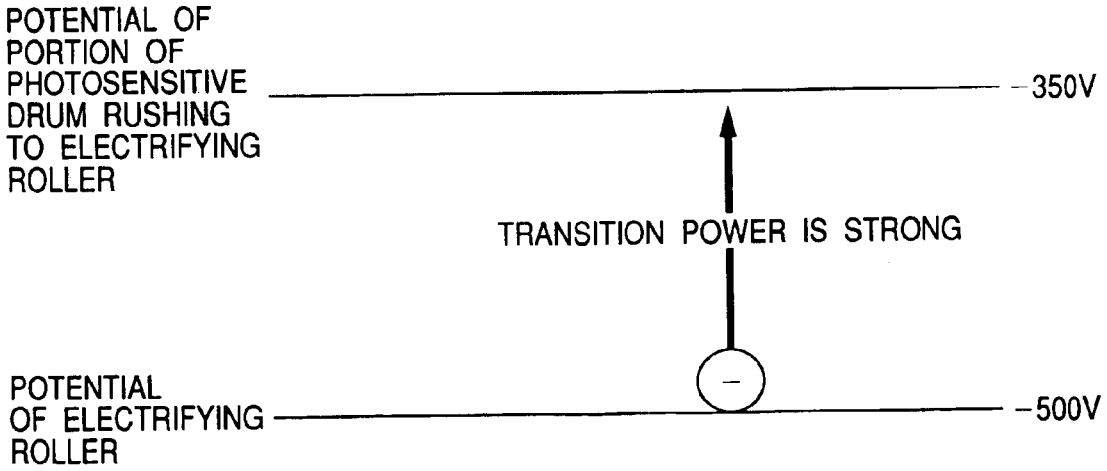
FIG. 14 is also a simplified drawing showing the potential relation during the cleaning sequence of the fourth embodiment.

In this embodiment, midway through the cleaning sequence, a direct-current voltage Vdc is switched from 0 V to −500 V. The drum potential Vbrush formed by the toner electrification amount control means is −350 V and this drum potential rushes to the electrifying roller. As shown in FIGS. 13 and 14, during the application of 0 V, the reversed toner having the positive polarity adhering to the electrifying roller is actively transferred onto the photosensitive drum by the potential difference with the drum potential Vbrush=−350 V of a portion entering into the electrifying roller (electrifying portion). Next, by applying −500 V, the toner having the negative polarity that is the normal polarity is actively transferred onto the photosensitive drum. By actively transferring the adhering toner having the positive polarity and the negative polarity onto the photosensitive drum using the potential difference in this manner, it becomes possible to effectively perform the cleaning of the electrifying roller. The toner having been transferred onto the photosensitive drum is transferred onto the intermediate transferring belt by press-contact transferring in the transferring portion and is recovered by the cleaning blade provided for the intermediate transferring belt. The voltage applied to the transferring member is set at 350 V that is the same as the voltage applied during the image forming. By setting the voltages in this manner, the toner having the negative polarity is actively transferred and the toner having the positive polarity tends to reside on the photosensitive drum. However, by sufficiently electrifying the positive polarity toner to have the negative polarity using two brush members, the residing toner also passes through the electrifying portion without adhering to the electrifying roller, is transferred onto the intermediate transferring belt during the next transferring, and is recovered by the intermediate transferring belt cleaner.

A time period, during which this cleaning sequence is carried out, is set as follows. During the pre-rotation, in the case where the direct-current voltage Vdc applied to the electrifying roller is set at around 0 V, the cleaning sequence is carried out while the electrifying roller is making one rotation. Also, in the case where the direct-current voltage Vdc is set at −500 V, the cleaning sequence is carried out while the electrifying roller is making one rotation. During the post-rotation, in the case where the direct-current voltage Vdc is set at around 0 V, the cleaning sequence is carried out while the electrifying roller is making two rotations. Also, in the case where the direct-current voltage Vdc is set at −500 V, the cleaning sequence is carried out while the electrifying roller is making two rotations.

During the cleaning sequence, in order to prevent the adhesion of developer to the photosensitive drum, the developing sleeve is stopped and an AC voltage is cut off. A direct-current voltage (DC voltage) is set at 0 V during the carrying-out of the cleaning sequence at 0 V because the photosensitive drum surface electrified to 0 V rushes into the developing portion. Also, the direct-current voltage is set at −350 V during the carrying-out of the cleaning sequence at −500 V because the photosensitive drum surface electrified to −500 V rushes into the developing portion. As a result of this setting, it becomes possible to prevent the adhesion of developer to the photosensitive drum with reliability.

By providing a potential difference on the positive polarity side and the negative polarity side with reference to the drum potential during the electrifying roller cleaning sequence in this manner, the transition power to the drum by this potential difference is increased. As a result of the synergistic effect with the strong peeling-off effect by the oscillating electric field acting between the photosensitive drum and the electrifying roller, it becomes possible to more effectively discharge toner having both polarities adhering to the electrifying roller onto the photosensitive drum and to carry out the cleaning sequence within a short time period.

As described above, an alternating-current voltage having a peak to peak voltage that is higher than that of the alternating-current voltage applied to the electrifying means during the image forming is applied during non-image forming. By doing so, there is increased an effect of peeling off developer adhering to the electrifying means from the electrifying means by means of an oscillating electric field acting between the electrifying means and the photosensitive drum. Consequently, it becomes possible to discharge the adhering developer onto the photosensitive drum. As a result of this effect, with no increase in cost, it becomes possible to maintain a clean condition of the electrifying roller surface at all times without using a new high-voltage power source or the like. As a result, it becomes possible to provide a good-quality image with stability for a long time period without causing any image fault such as poor electrification and electrification unevenness due to stains.

What is claimed is:

1. An image forming apparatus comprising:

an image bearing member;

electrifying means in contact with said image bearing member for electrifying said image bearing member in order to form an electrostatic image on said image bearing member, a voltage, in which a direct-current voltage and an alternating-current voltage are superimposed on each other, being applied to said electrifying means; and developing means for developing the electrostatic image formed on said image bearing member using toner, wherein after a toner image on said image bearing member is transferred onto a transferring medium, residual toner residing on said image bearing member is carried to a contact portion between said electrifying means and said image bearing member in accordance with rotation of said image bearing member, and a peak to peak voltage of the alternating-current voltage applied to said electrifying means in order to discharge the residual toner adhering to said electrifying means onto said image bearing member during a certain period of non-image forming is set so as to be higher than a peak to peak voltage of the alternating-current voltage applied to said electrifying means during image forming.

2. An image forming apparatus according to claim 1, wherein the peak to peak voltage of the alternating-current voltage applied to said electrifying means during the period of non-image forming is set so as to be equal to or less than 1.1 to 2.0 times the peak to peak voltage applied to said electrifying means during image forming.

3. An image forming apparatus according to claim 1, wherein an application condition concerning the alternating-current voltage applied to said electrifying means during the period of non-image forming is set so that an unevenness of a surface potential of said image bearing member during the period of non-image forming becomes larger than an unevenness during image forming.

4. An image forming apparatus according to claim 1, wherein a frequency of the alternating-current voltage applied to said electrifying means during the period of non-image forming is set so as to be lower than a frequency of the alternating current voltage during image forming.

5. An image forming apparatus according to any one of claims 1 to 4, wherein a polarity of the direct-current voltage applied to said electrifying means in order to discharge residual toner adhering to said electrifying means onto said image bearing member is approximately the same polarity as a polarity of a direct-current voltage applied to said electrifying means during image forming.

6. An image forming apparatus according to claim 5, wherein the direct-current voltage applied to said electrifying means in order to discharge residual toner adhering to said electrifying means onto said image bearing member is approximately the same voltage as the direct-current voltage applied to said electrifying means during image forming.

7. An image forming apparatus according to claim 6, wherein an electrification polarity of said image bearing member is the same polarity as an electrification polarity of normal toner.

8. An image forming apparatus according to claim 5, wherein during image forming, said developing means is capable of recovering the residual toner on said image bearing member.

9. An image forming apparatus according to claim 5, further comprising:

cleaning means for recovering residual toner residing on said transferring medium after the toner image on said transferring medium is transferred onto a recording material, wherein the residual toner discharged from said electrifying means onto said image bearing member is then transferred onto the transferring medium and is recovered by said cleaning means.

10. An image forming apparatus according to claim 9, wherein a plurality of sets of said image bearing member, said electrifying means, and said developing means are provided in order to form toner images in colors differing from each other on the transferring medium.

11. An image forming apparatus comprising:

an image bearing member for bearing an electrostatic image;

electrifying means for electrifying said image bearing member so as to achieve a substantially uniform electrical potential, said electrifying means nip-contacting with said image bearing member so as to form a gap therebetween for discharging said image bearing member;

voltage applying means for applying a voltage in which a direct-current voltage and an alternating-current voltage are superimposed on each other;

developing means for developing the electrostatic image using toner; and transferring means for transferring a toner image on said image bearing member onto a transferring medium, wherein said developing means recovers residual toner on said image bearing member, and said voltage applying means applies the alternating-current voltage, which has a peak to peak voltage larger than a peak to peak voltage to be applied to said electrifying means during image forming, during a certain period of non-image forming, in order to facilitate transferring of the toner residing on said electrifying means onto said image bearing member.

12. An image forming apparatus according to claim 11, wherein a waveform of the alternating-current voltage applied during the period of non-image forming is set so as to differ from a waveform during image forming.

* * * * *